US009566780B2

(12) United States Patent
Landa et al.

(10) Patent No.: US 9,566,780 B2
(45) Date of Patent: Feb. 14, 2017

(54) TREATMENT OF RELEASE LAYER

(71) Applicant: LANDA CORPORATION LTD., Rehovot (IL)

(72) Inventors: Benzion Landa, Nes Ziona (IL); Meir Soria, Jerusalem (IL); Sagi Abramovich, Ra'anana (IL)

(73) Assignee: LANDA CORPORATION LTD., Rehovot ( * ) Notice: Subject to any disclaimer, the term of this patent is extended or adjusted under 35 U.S.C. 154(b) by 0 days.

(21) Appl. No.: 14/917,505

(22) PCT Filed: Sep. 11, 2014

(86) PCT No.: PCT/IB2014/002366

§ 371 (c)(1),
(2) Date: Mar. 8, 2016

(87) PCT Pub. No.: WO2015/036864

PCT Pub. Date: Mar. 19, 2015

(65) Prior Publication Data

US 2016/0207306 A1 Jul. 21, 2016

Related U.S. Application Data

(60) Provisional application No. 61/876,747, filed on Sep. 11, 2013, provisional application No. 61/877,277, filed on Sep. 12, 2013.

(51) Int. Cl.
*B41J 2/005* (2006.01)
*B41M 5/025* (2006.01)
(Continued)

(52) U.S. Cl.
CPC ..... *B41J 2/0057* (2013.01); *B41J 2/01* (2013.01); *B41M 5/0256* (2013.01); *B41M 5/03* (2013.01);
(Continued)

(58) Field of Classification Search
None
See application file for complete search history.

(56) References Cited

U.S. PATENT DOCUMENTS 5,991,590 A 11/1999 Chang et al.
6,094,558 A 7/2000 Shimizu et al.
(Continued)

FOREIGN PATENT DOCUMENTS

EP 2683556 A1 1/2014
JP 2004019022 A 1/2004
(Continued)

OTHER PUBLICATIONS

JP2004019022 Machine Translation (by EPO and Google)—published Jan. 22, 2004; Yamano et al.
(Continued)

*Primary Examiner* — Lisa M Solomon
(74) *Attorney, Agent, or Firm* — Daniel Feigelson; Fourth Dimension IP

(57) ABSTRACT

A method for treating a hydrophobic release layer of an intermediate transfer member for use in a printing process in which a negatively charged aqueous inkjet ink is jetted onto the surface of this layer. The method comprises contacting the release layer with a chemical agent which is an amine functionalized silicone. Transfer members comprising such a treated release layer and images printed therefrom are also disclosed.

20 Claims, 6 Drawing Sheets

(51) Int. Cl.

| | |
|---|---|
| ***B41M 5/03*** | (2006.01) |
| ***B41J 2/01*** | (2006.01) |
| *B41M 5/36* | (2006.01) |
| *B41M 5/00* | (2006.01) |
| *B41J 2/21* | (2006.01) |
| *B41J 11/00* | (2006.01) |
| *B41N 10/00* | (2006.01) |

(52) U.S. Cl.
CPC ..... *B41J 2/2114* (2013.01); *B41J 11/0015* (2013.01); *B41J 2002/012* (2013.01); *B41M 5/0011* (2013.01); *B41M 5/36* (2013.01); *B41N 10/00* (2013.01)

(56) References Cited

U.S. PATENT DOCUMENTS

| | | | | |
|---|---|---|---|---|
| 6,261,688 | B1 | 7/2001 | Kaplan et al. | |
| 6,551,716 | B1 | 4/2003 | Landa et al. | |
| 6,586,100 | B1 | 7/2003 | Pickering et al. | |
| 8,192,904 | B2 | 6/2012 | Nagai et al. | |
| 2003/0232945 | A1* | 12/2003 | Pickering | C08G 77/04 528/10 |
| 2007/0120927 | A1 | 5/2007 | Snyder et al. | |
| 2008/0112912 | A1* | 5/2008 | Springob | A61K 8/34 424/70.12 |
| 2010/0111577 | A1 | 5/2010 | Soria et al. | |
| 2012/0140009 | A1 | 6/2012 | Kanasugi et al. | |

FOREIGN PATENT DOCUMENTS

| | | | |
|---|---|---|---|
| WO | WO2004113082 | A1 | 12/2004 |
| WO | WO2007145378 | A1 | 12/2007 |
| WO | WO2012014825 | A1 | 2/2012 |
| WO | WO2013060377 | A1 | 5/2013 |
| WO | WO2013132438 | A2 | 9/2013 |

OTHER PUBLICATIONS

"Amino Functional Silicone Polymers", in Xiameter—© 2009 Dow Corning Corporation.

* cited by examiner

TREATMENT OF RELEASE LAYER

FIELD AND BACKGROUND

The present invention relates to indirect printing systems and more particularly to compositions suitable for the treatment of intermediate transfer members.

Digital printing techniques have been developed that allow a printer to receive instructions directly from a computer without the need to prepare printing plates, as in the more traditional offset methods. Various printing systems exist which may use either dry inks, such as the toners used in laser printers, or liquid inks having either organic or aqueous solvents or carriers. Such technologies may rely on direct application of inks in an image pattern onto paper or any other substrate, as in ink jetting commonly used in home and office printers, or they may rely on indirect printing in which a mirror image is first formed on an intermediate member and then transferred therefrom to the substrate. Such indirect method, more frequent in commercial settings, is exemplified by the liquid electro-photographic process in which an electrostatic image is first produced on an electrically charged image bearing cylinder by exposure to laser light. The electrostatic charge attracts oil-based inks to form a color ink image which is then transferred by way of a blanket cylinder onto the printing substrate (e.g., paper, cardboard, plastic etc.).

Such processes suffer from drawbacks. In liquid ink processes, for instance, the use of organic-based solvents creates a challenging safety and environmental concern. Direct ink jetting of liquid inks, typically aqueous, yields, on the other hand, limited resolution due to wicking of the inks into fibrous substrates, such as paper. Though such problems might be partially addressed by the use of substrates with special coatings engineered to absorb the liquid ink in a controlled fashion or to prevent its penetration below the surface of the substrate, such a solution is not suitable for certain printing applications and its cost makes it not viable for commercial printing. Furthermore, the use of coated substrates creates its own problems in that the surface of the substrate remains wet and additional costly and time consuming steps are needed to dry the ink, so that it is not later smeared as the substrate is being handled, for example stacked or wound into a roll. In addition, excessive wetting of the substrate causes cockling and makes printing on both sides of the substrate (also termed perfecting or duplex printing) difficult, if not impossible.

Moreover, inkjet printing directly onto porous paper, or other fibrous material, results in poor image quality because of variation of the distance between the print head and the surface of the substrate.

Using an indirect printing technique overcomes many problems associated with inkjet printing directly onto the substrate. It allows the distance between the surface of the intermediate image transfer member and the inkjet print head to be maintained constant and reduces wetting of the substrate, as the ink can be dried on the surface of the intermediate transfer member (also termed the release layer) before being applied to the substrate.

The present Applicant has recently disclosed printing processes wherein inks including an organic polymeric resin and a coloring agent in an aqueous carrier are jetted at an image forming station onto an intermediate transfer member having a hydrophobic release layer. The ink image so formed is dried to leave a residue film of resin and coloring agent before being transferred to the desired substrate at an impression station. Such processes were concerned with balancing factors having contradictory requisites to achieve print quality. For instance, the ink droplets need to sufficiently adhere to the release layer at the image forming station not to be affected by the movement of the transfer member, whereas the dried ink films need to easily detach therefrom at the impression station. While silicone coated transfer members are preferred to facilitate transfer of the dried image to the final substrate, their hydrophobicity causes aqueous ink droplets to bead on the transfer member. This makes it more difficult to remove the water in the ink and also results in a small contact area between the droplet and the blanket that renders the ink image unstable during rapid movement. The earlier disclosed printing processes of the Applicant are believed to be based on spontaneous and reversible electrostatic mechanisms. The proper selection of the chemical compositions of the ink and of the surface of the intermediate transfer member results in attractive intermolecular forces between molecules on the outer surface of each droplet and on the surface of the intermediate transfer member. It was observed that such interactions, though substantially devoid of irreversible chemical reactions, are sufficient to counteract the tendency of the flattened disk-shaped ink film produced by each impinging droplet to bead under the action of the surface tension of the aqueous carrier, without causing each droplet to spread by wetting the surface of the intermediate transfer member. This subtle equilibrium can be optionally achieved with the assistance of a chemical agent being applied to the surface of the release layer before jetting of the ink droplet, the composition comprising such agent being referred to as a conditioning fluid.

Advantageously, the final image quality on the substrate obtained in printing systems based on the previously described processes is less affected by the physical properties of the substrate and benefit from various other advantages as a result of the image remaining above the substrate surface.

The present invention is concerned with chemical agents that can effectively treat the release layer of intermediate transfer members in indirect printing systems.

BRIEF DESCRIPTION

The presently claimed invention pertains to a particular aspect of a novel printing process and system for indirect digital inkjet printing using aqueous inks, other aspects of which are described and claimed in other applications of the same Applicant which have been filed or will be filed at approximately the same time as the present application. Further details on examples of such printing systems are provided in co-pending PCT publications Nos. WO 2013/132418, WO 2013/132419 and WO 2013/132420 which are incorporated herein by reference. A non-limitative description of such printing systems will be provided below.

Briefly, the printing process shared in particular, but not exclusively, by the above-mentioned systems, comprises directing droplets of an aqueous inkjet ink onto an intermediate transfer member having a hydrophobic release layer to form an ink image on the release layer, the ink including an organic polymeric resin and a coloring agent in an aqueous carrier, and the transfer member having a hydrophobic outer surface. Upon impinging upon the intermediate transfer member, each ink droplet in the ink image spreads to form an ink film. The ink is then dried while the ink image is being transported by the intermediate transfer member, by evaporating the aqueous carrier from the ink image to leave a residue film of resin and coloring agent. The residue film is then transferred to a substrate. Without wishing to be bound by theory, it is presently believed that mutually attractive intermolecular forces between molecules in the outer region of each ink droplet nearest the surface of the intermediate transfer member and molecules on the surface of the intermediate transfer member itself (e.g., between negatively charged molecules in the ink and positively charged molecules on the surface of the intermediate transfer member) counteract the tendency of the ink film produced by each droplet to bead under the action of the surface tension of the aqueous carrier, without causing each droplet to spread by wetting the surface of the intermediate transfer member. The presently claimed invention pertains to a method of treating the surface of the intermediate transfer member to enable its sufficient interaction with the molecules of the ink, including chemical agents suitable for use in such a method, as well as printed articles obtainable by the use of said method and agents.

In accordance with an embodiment of the present invention, in a printing process such as that just described or as will described in more detail hereinbelow, in which an aqueous inkjet ink containing a negatively charged polymeric resin is jetted onto a hydrophobic release layer prior to being transferred to a substrate, there is provided a method for treating the release layer prior to the jetting of the aqueous ink onto the release layer, the method comprising contacting the release layer with a chemical agent which is an amine functionalized silicone, the amine functionalized silicone having at least 0.3 wt. % nitrogen and further being characterized by at least one of the following: (a) at least 33 wt. % silicon, (b) an amine number of at least 7 (c) an amine number of not more than 1,000, preferably not more than 300, (d) a molecular weight (MW) of not more than 1,000,000, preferably not more than 50,000 (e) a molecular weight of at least 500, (f) no more than one hydroxyl or alkyoxy group per molecule of amine functionalized silicone, (g) a kinematic viscosity of at least 10 square millimeters per second ($mm^2/s$), (h) a kinematic viscosity of not more than 1,000,000 $mm^2/s$, preferably not more than 100,000 $mm^2/s$. In some embodiments, the chemical agent is present in a vehicle or carrier (e.g., an emulsion) when it is contacted with the release layer. In some embodiments, the vehicle is an oil-in-water emulsion. The liquid comprising the chemical agent (e.g., in dispersion or emulsion) may be referred to hereinafter as the treatment or conditioning liquid. In some embodiments, the chemical agent can be a combination of chemical agents as afore-described.

In some embodiments, the positive charge density of the chemical agent is at least 0.1 milliequivalent per gram (meq/g), at least 0.5 meq/g, at least 1 meq/g, at least 2 meq/g, at least 3 meq/g, at least 4 meq/g, at least 5 meq/g, 6 meq/g, at least 7 meq/g, at least 8 meq/g, at least 9 meq/g, or at least 10 meq/g of chemical agent.

In some embodiments, the chemical agent has an amine number of at least 7, at least 8, at least 9, at least 10, at least 11, at least 12, at least 13, at least 14, at least 15, at least 16, at least 17, at least 18, at least 19, at least 20, at least 25, at least 30, at least 35, at least 40, at least 45, at least 50, at least 55, at least 60, at least 65, at least 70, at least 75, at least 80, at least 85, or at least 90. In some embodiments the chemical agent has an amine number of not more than 1,000, not more than 500, not more than 400, not more than 300, not more than 295, not more than 290, not more than 285, not more than 280, not more than 275, not more than 270, not more than 265, not more than 260, not more than 255, not more than 250, not more than 245, not more than 240, not more than 235, not more than 230, not more than 225, not more than 220, not more than 215, not more than 210, not more than 205, not more than 200, not more than 195, not more than 190, not more than 185, not more than 180, not more than 175, not more than 170, not more than 165, not more than 160, not more than 155, not more than 150, not more than 145, not more than 140, not more than 135, not more than 130, not more than 125, or not more than 120.

In some embodiments, the chemical agent has an average molecular weight of at least 500, at least 800, at least 1,000, at least 1,300, at least 1,700, at least 2,000, at least 2,500, at least 3,000, at least 3,500, at least 4,000, at least 4,500, at least 5,000, at least 10,000, at least 15,000, at least 20,000, at least 25,000, at least 50,000, at least 100,000, at least 150,000, at least 200,000, at least 250,000, at least 500,000, at least 750,000, or at least 1,000,000. In some embodiments, the chemical agent has an average molecular weight of at most 100,000, at most 50,000, at most 25,000, at most 20,000, at most 15,000, at most 10,000, at most 5,000, at most 4,500, at most 4,000, at most 3,500, at most 3,000, or at most 2,500.

In some embodiments, the chemical agent is a polymer which comprises one or more positively chargeable nitrogen atoms. By a "positively chargeable polymer" or "positively chargeable group" is meant a polymer or chemical moiety which either can readily add a proton (e.g., $—NH_2$) or has a permanent positive charge (e.g., $—N(CH_3)_3^+$); as used herein, the term refers to an inherent property of the polymer or moiety, and thus may encompass polymers or moieties which are in an environment in which such protons are added, as well as polymers in an environment in which such protons are not added. In contrast, the term "a positively charged" polymer or group refers to a polymer or group in an environment in which one or more such protons have been added or which has a permanent positive charge. In some embodiments, the one or more chargeable nitrogen atoms of the chemical agent are selected from the group of primary, secondary and tertiary amines and quaternary ammonium groups and combinations of such groups. In some embodiments, such groups are covalently bound to a polymer at a terminal position thereof, i.e. at the terminus of the backbone or a side-chain. In some embodiments the one or more nitrogen atoms are part of a cyclic moiety. In some embodiments, the one or more nitrogen atoms constitute at least 0.3%, at least 0.4%, at least 0.5%, at least 0.6%, at least 0.7%, at least 0.8%, at least 0.9%, at least 1%, at least 1.1%, at least 1.2%, at least 1.3%, at least 1.4%, at least 1.5%, at least 1.6%, at least 1.7%, at least 1.8%, at least 1.9%, at least 2%, at least 2.1%, at least 2.2%, at least 2.3%, at least 2.4%, at least 2.5%, at least 3%, at least 4%, at least 5%, at least 8%, at least 10%, or at least 15% by weight (wt. %) of the chemical agent. In some embodiments, the one or more nitrogen atoms constitute not more than 15%, not more than 14%, not more than 13%, not more than 12%, not more than 11%, or not more than 10% by weight of the chemical agent.

In some embodiments, silicon atoms constitute at least 20%, at least 22%, at least 24%, at least 26%, at least 28%, at least 30%, at least 31%, at least 32%, at least 33%, at least 34%, at least 35%, at least 36%, at least 37%, at least 38%, at least 39%, or at least 40% by weight of the chemical agent.

In some embodiments, the chemical agent has at most 1.0, at most 0.8, at most 0.6, at most 0.4, or at most 0.3 Si—H groups, per molecule of amine functionalized silicone.

In some embodiments, the chemical agent has at most 1.0, at most 0.8, at most 0.6, at most 0.4, or at most 0.3 C=C groups, per molecule of amine functionalized silicone.

In some embodiments, the chemical agent is a liquid at room temperature (~23° C.). In some embodiments the chemical agent in neat form has a kinematic viscosity of at least 10, at least 15, at least 20, at least 25, at least 30, at least 35, at least 40, at least 45 or at least 50 $mm^2/s$ (centiStokes) at room temperature. In some embodiments the chemical agent in neat form has a kinematic viscosity of at most 100,000, at most 50,000, at most 25,000, at most 20,000, at most 15,000, at most 10,000, at most 5,000, at most 1000, at most 500, at most 400, at most 300 or at most 200 $mm^2/s$ at room temperature.

In some embodiments, the chemical agent is a linear polymer. In some embodiments the chemical agent is a branched polymer. In some embodiments the polymer is a copolymer. In some embodiments the copolymer is a block copolymer. In some embodiments the polymer has amine groups pendant from the polymer backbone. Examples of such embodiments are illustrated by compounds of formula I with pendant mono-amines and compounds of formula III with pendant di-amines, as shown hereinbelow. In some embodiments the polymer has amine groups at one or more termini of the polymer. Examples of such embodiments are illustrated by compounds of formula III, as shown hereinbelow.

In some embodiments the block copolymer has the structure of formula I:

Formula (I)

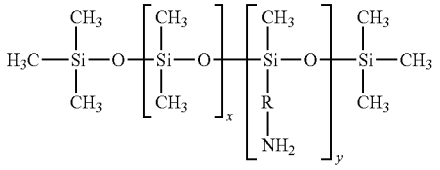

wherein R is $C_{1-6}$ alkyl, the blocks bearing the subscripts x and y may be randomly mixed, the total value of x is from 10 to 5,000, preferably in range of 10 to 400, for example 58 or 100 or 118, and the total value of y is from 2 to 20, preferably 2 to 11, for example 4 or 11. In some embodiments x is 58 and y is 4; x is 100 and y is 4; or x is 118 and y is 11. In some embodiments, R is a linear $C_3H_6$ group.

In some embodiments the polymer has the structure of formula II:

Formula (II)

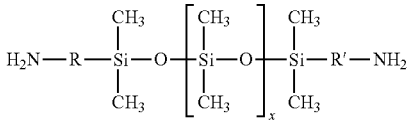

wherein x is from 5 to 5,000, preferably 10 to 2,000, e.g., 10, and R and R', which may be the same or different, are each saturated, linear or branched alkyl groups of 1 to 6 carbon atoms, e.g., a linear $C_3H_6$ group.

In some embodiments the block copolymer is a branched diamino functional polydimethylsiloxane of formula III:

Formula (III)

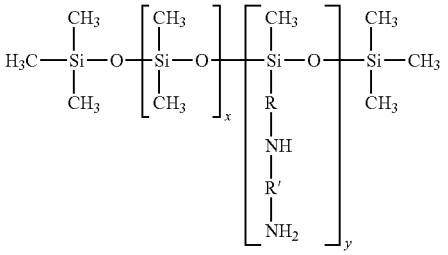

wherein the blocks bearing the subscripts x and y may be randomly mixed, the total value of x is from 5 to 5,000, preferably 10 to 800, e.g., 400, the total value of y is from 1 to 20, e.g., 8, and R and R', which may be the same or different, are each saturated, linear or branched alkyl groups of 1 to 6 carbon atoms, e.g., R is a linear $C_3H_6$ group and R' is a linear $C_2H_4$ group.

In some embodiments, a methyl group of one or more dimethyl siloxane repeating units (—$(CH_3)_2$—Si—O—) of the silicone polymers, according to any of formulae (I), (II) and (III), can be further substituted by polyether groups comprising —$(OC_2H_4)_a(OC_3H_6)_b$— optionally terminated by a short alkoxyl (e.g., of 4 carbon atoms or less) or an hydroxyl group.

In some embodiments, the chemical agent is selected from the group comprising GP-4 (a compound of formula I wherein R=$(CH_2)_3$, x=58 and y=4, available for example from Genesee Polymers Corporation, Burton, Mich., USA), GP-6 (a compound of formula I wherein R=$(CH_2)_3$, x=100 and y=4, available for example from Genesee Polymers Corporation), GP-316 (a compound of formula III wherein R=$(CH_2)_3$, R'=$(CH_2)_2$, x=400 and y=8, available for example from Genesee Polymers Corporation), GP-345 (a compound of formula III wherein R=$(CH_2)_3$, R'=$(CH_2)_2$, x=800 and y=2, available for example from Genesee Polymers Corporation), GP-581 (a compound of formula I wherein R=$(CH_2)_3$, x=118 and y=11, available for example from Genesee Polymers Corporation), X-22 3939A (a compound of formula I wherein part of the dimethyl siloxane repeating units are further substituted by polyether groups, the compound having a reactive group equivalent weight of 1,700 g/mol, available for example from Shin-Etsu Chemical Company), GP-965 (a compound of formula II wherein R=R'=$(CH_2)_3$, x=10, available for example from Genesee Polymers Corporation), KF-861 (a compound of formula III having an amine number of about 127, available for example from Shin-Etsu Chemical Company, Silicone Division, Tokyo, Japan), KF-864 (a compound of formula I having an amine number of about 27-30, available for example from Shin-Etsu Chemical Company), KF-869 (a compound of formula III having an amine number of about 54, available for example from Shin-Etsu Chemical Company), Silamine® A0 EDA (a compound of formula III wherein R=$(CH_2)_3$, R'=$(CH_2)_2$, having an amine number of about 230, available for example from Siltech Corporation, Toronto, Ontario, Canada), Silamine® D2 EDA (a compound of formula III wherein R=$(CH_2)_3$, R'=$(CH_2)_2$, having an amine number of about 230-250 and an average MW of about 1,700, available for example from Siltech Corporation), Silamine® D208 EDA (a compound of formula III, wherein part of the dimethyl siloxane repeating units are further substituted by polyether groups and wherein R=$(CH_2)_3$, R'=$(CH_2)_2$, the compound having an amine number of about 20-40 and an average MW of about 2,500, available, for example, from Siltech Corporation), commercial alternatives thereof (such as amine silicones from other suppliers, as will be appreciated by persons skilled in the art), and mixtures thereof.

In some embodiments, the chemical agent is stable at temperatures of up to at least 80° C., at least 100° C., at least 125° C., or at least 150° C. In this context, "stable" means that decomposition is not observed using thermogravimetric analysis (TGA). It will be appreciated by persons skilled in the art that the suitability of any particular chemical agent will depend, in part, at the temperature at which it is to be used, i.e. the temperature of the intermediate transfer member to which it is to be applied.

In some embodiments, when the chemical agent is contacted with the release layer of the intermediate transfer member as part of an oil-in-water emulsion, the concentration of the chemical agent in the emulsion prior to application is not more than 20 wt. %, not more than 15 wt. %, not more than 10 wt. %, not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %. In some embodiments, the concentration of the chemical agent in the emulsion prior to application is at least 5 wt. %, at least 4 wt. %, at least 3 wt. %, at least 2 wt. %, at least 1 wt. %, at least 0.5 wt. %, at least 0.4 wt. %, at least 0.3 wt. %, at least 0.2 wt. %, or at least 0.1 wt. %. In some embodiments, the emulsion further comprises an emulsifier. In some embodiments, the emulsifier is chosen from the group consisting of cationic and non-ionic surfactants. An example of a suitable non-ionic surfactant is 4-(1,1,3,3-tetramethylbutyl)phenyl polyethylene glycol (Triton X-100, CAS number 9002-93-1). An example of a suitable cationic surfactant is hexadecyltrimethylammonium bromide (CAS number 57-09-0). In some embodiments the emulsifier is present in the emulsion in a concentration of not more than 10%, not more than 5%, 2%, not more than 1%, not more than 0.5%, not more than 0.1%, or not more than 0.05% by weight of the emulsion. In some embodiments, the emulsion is formed by mixing an appropriate amount of the chemical agent in water, optionally with an emulsifier, until an emulsion is formed.

In some embodiments, the chemical agent is applied to the release layer using a roller. In some embodiments, the chemical agent is applied by spraying from a position facing the transfer member outer surface, either from above the blanket in its upper run or from below in its lower run. In some embodiments, the chemical agent is applied by contacting the release layer with a film of conditioning liquid overlying an applicator cloth. In some embodiments using an applicator comprising such an applicator cloth, the treatment liquid is applied by jetting the liquid from underneath the cloth in a manner that facilitates the passage of the liquid through the cloth to form a liquid film that can contact the release layer, whilst it prevents the cloth from contacting the surface of the intermediate transfer member. In some embodiments, the conditioning liquid comprising the chemical agent applied to the release layer or surplus of said liquid is evened on or removed from the surface of the transfer member using a metering roller, squeegee rollers and/or an air knife. In some embodiments, the metering roller is chrome-plated.

In some embodiments, the chemical agent is applied to the release layer so that the thickness of the conditioning liquid (e.g., oil-in-water emulsion of chemical agent) on the release layer prior to removal of the bulk of the carrier is less than 1,000 micrometers (μm), less than 900 μm, less than 800 μm, less than 700 μm, less than 600 μm, less than 500 μm, less than 400 μm, less than 300 μm, less than 200 μm, less than 100 μm, less than 50 μm, less than 10 μm, or less than 1 μm.

In some embodiments, the method further comprises removing (e.g., evaporating) the vehicle or carrier (e.g., water) in which the chemical agent is carried. In some embodiments, the average thickness of the chemical agent on the release layer after evaporation of the carrier is not more than 1,000 nanometers (nm), not more than 900 nm, not more than 800 nm, not more than 700 nm, not more than 600 nm, not more than 500 nm, not more than 400 nm, not more than 300 nm, not more than 200 nm, not more than 100 nm, not more than 90 nm, not more than 80 nm, not more than 70 nm, not more than 60 nm, not more than 50 nm, not more than 40 nm, not more than 30 nm, not more than 20 nm, not more than 15 nm, not more than 10 nm, not more than 9 nm, not more than 8 nm, not more than 7 nm, not more than 6 nm, not more than 5 nm, not more than 4 nm, not more than 3 nm, not more than 2 nm, or not more than 1 nm.

In some embodiments, the concentration of the chemical agent on the release layer after removal of the carrier is not more than 50 milligrams (mg) per square meter, not more than 40 $mg/m^2$, not more than 30 $mg/m^2$, not more than 20 $mg/m^2$, not more than 10 $mg/m^2$, not more than 5 $mg/m^2$, not more than 4 $mg/m^2$, not more than 3 $mg/m^2$, not more than 2 $mg/m^2$, not more than 1 $mg/m^2$, not more than 0.5 $mg/m^2$, not more than 0.1 $mg/m^2$, not more than 0.05 $mg/m^2$ or not more than 0.01 $mg/m^2$.

In some embodiments, the hydrophobic outer release layer comprises a silane, silyl or silanol-modified or -terminated polydialkylsiloxane silicone polymer, or hybrids of such polymers. In some embodiments, these silicone polymers have been cross-linked by condensation curing of the silane groups. Thus, in some embodiments, the release layer comprises a cross-linked silanol- or silyl-terminated polydialkylsiloxane. In some embodiments, the hydrophobic outer release layer comprises silanol-terminated polydialkylsiloxane cross-linked with a polyethylsilicate oligomer. In some embodiments, the release layer is formed by condensation curing. In some embodiments, the release layer is formed by addition curing. In some embodiments, the surface energy of the release layer is in the range of 18-22 dyne/cm (=10 μN/cm=1 mN/m) (see "Surface properties of Silicone Release Coatings", Dr Michael Owen, Dow Corning PRA 2$^{nd}$ Conference Silicone in Coatings, January 1996) at 29° C.

In some embodiments, the temperature of the release layer when contacted with the chemical agent is at least 40° C., at least 60° C., at least 80° C., at least 100° C., at least 110° C., at least 120° C., at least 130° C., at least 140° C. or at least 150° C. In some embodiments, the temperature of the release layer when contacted with the chemical agent is not more than 150° C., not more than 140° C., not more than 130° C., not more than 120° C., not more than 110° C., not more than 100° C., or not more than 90° C. It will be appreciated that although in general the chemical agent will be part of an oil-in-water emulsion when it is brought into contact with the release layer, it may in principle be contacted in neat form, or as part of a water-in-oil emulsion, although it has been found that the chemical agents that are effective in accordance with embodiments of this invention tend to have low solubility in water.

In some embodiments, the change in the contact angle of a drop of distilled water on the release layer to which the conditioning liquid (e.g., the emulsion of the chemical agent) has been applied and the carrier (e.g., water) removed therefrom is not more than 10 degrees, not more than 9 degrees, not more than 8 degrees, not more than 7 degrees, not more than 6 degrees, not more than 5 degrees, not more than 4 degrees, not more than 3 degrees, not more than 2 degrees, not more than 1 degree relative to a drop of distilled water on the release layer to which the chemical agent has not been applied. In some embodiments, the change is at least 0.1 degrees, at least 0.2 degrees, at least 0.3 degrees, at least 0.4 degrees, at least 0.5 degrees, at least 0.6 degrees, at least 0.7 degrees, at least 0.8 degrees, at least 0.9 degrees or at least 1 degree relative to a drop of distilled water on the release layer to which the chemical agent has not been applied.

In some embodiments, the reduction in the contact angle of a drop of distilled water on the release layer to which the conditioning liquid (e.g., the emulsion of chemical agent) has been applied and the carrier (e.g., water) removed therefrom is not more than 20%, not more than 15%, not more than 10%, not more than 9%, more than 8%, not more than 7%, not more than 6%, not more than 5%, not more than 4%, not more than 3%, not more than 2%, or not more than 1% relative to the contact angle of a drop of distilled water on the release layer to which the chemical agent has not been applied. In some embodiments, the reduction in the contact angle is at least 0.1%, at least 0.2%, at least 0.3%, at least 0.4%, at least 0.5%, at least 0.6%, at least 0.7%, at least 0.8%, at least 0.9%, or at least 1% relative to the contact angle of a drop of distilled water on the release layer to which the chemical agent has not been applied. In some embodiments, the contact angle on the release layer to which the chemical agent has been applied and the carrier removed therefrom is at least 90 degrees.

In some embodiments, the method further comprises jetting an ink drop to form an ink film on the chemical agent on the release layer, wherein the ratio of charges in the ink film to the charges in the chemical agent in the region covered by said ink film is at least at least 10:1, at least 20:1, at least 30:1, at least 40:1, at least 50:1, at least 60:1, at least 70:1, at least 80:1, at least 90:1, at least 100:1, at least 110:1, or at least 120:1.

In some embodiments, the method further comprises jetting an aqueous inkjet ink image on the release layer having the chemical agent thereupon; the aqueous inkjet ink comprising an aqueous solvent, a colorant which is preferably a pigment, and a negatively chargeable polymeric resin; removing the solvent from the jetted aqueous inkjet ink; and transferring the image to a substrate. In some embodiments the substrate is coated paper. In some embodiments the substrate is uncoated paper.

In some embodiments of such methods, when the substrate is Condat Gloss® 135 gsm coated paper, the optical density of the printed image on the substrate is at least 50% greater than the optical density of the same image when printed under identical conditions but without application of the chemical agent to the release layer. In some embodiments, the optical density is at least 60% greater. In some embodiments, the optical density is at least 70% greater. In some embodiments, the optical density is at least 80% greater. In some embodiments, the optical density is at least 90% greater. In some embodiments, the optical density is at least 100% greater, or at least 150% greater, or at least 200% greater or at least 250% greater, or at least 300% greater, or at least 350% greater, or at least 400% greater, or at least 450% greater, or at least 500% greater, or at least 600% greater.

There is also provided, in accordance with an embodiment of the invention, an article comprising a hydrophobic release layer of an intermediate transfer member of a printing system, the hydrophobic release layer having disposed thereupon a chemical agent which is an amine functionalized silicone, the amine functionalized silicone having at least 0.3 wt. % nitrogen and further being characterized by at least one of the following: (a) at least 33 wt. % silicon, (b) an amine number of at least 7, (c) an amine number of not more than 1,000, preferably not more than 300, (d) a molecular weight of not more than 1,000,000, preferably not more than 50,000 (e) a molecular weight of at least 500, (f) no more than one hydroxyl or alkyoxy group per molecule of amine functionalized silicone, (g) a viscosity of at least 10 square millimeters per second ($mm^2/s$) (centiStokes), (h) a viscosity of not more than 1,000,000 $mm^2/s$, preferably not more than 100,000 $mm^2/s$.

In some embodiments of such an article, the polymer disposed on the release layer contains one or more chargeable nitrogen atoms.

In some embodiments of such an article, the thickness of the chemical agent disposed on the release layer is not more than 1,000 nm, not more than 900 nm, not more than 800 nm, not more than 700 nm, not more than 600 nm, not more than 500 nm, not more than 400 nm, not more than 300 nm, not more than 200 nm, not more than 100 nm, not more than 90 nm, not more than 80 nm, not more than 70 nm, not more than 60 nm, not more than 50 nm, not more than 40 nm, not more than 30 nm, not more than 20 nm, not more than 10 nm, not more than 9 nm, not more than 8 nm, not more than 7 nm, not more than 6 nm, not more than 5 nm, not more than 4 nm, not more than 3 nm, not more than 2 nm, or not more than 1 nm. The foregoing thickness of the chemical agent is typically measured following the removal (e.g., evaporation) of a vehicle in which the chemical agent has been applied to the release layer of the transfer member.

In some embodiments of such an article, the chemical agent disposed upon the release layer has an average molecular weight of at least 800, at least 1,000, at least 1,300, at least 1,700, at least 2,000, at least 2,500, at least 3,000, at least 3,500, at least 4,000, at least 4,500, at least 5,000, of at least 10,000, at least 15,000, at least 20,000, at least 25,000, or at least 50,000. In some embodiments, the chemical agent has an average molecular weight of at most 100,000, at most 50,000, at most 25,000, at most 20,000, at most 15,000, at most 10,000, at most 5,000, at most 4,500, at most 4,000, at most 3,500, at most 3,000, or at most 2,500.

In some embodiments of such an article, the positive charge density of the chemical agent disposed upon the release layer is at least 0.1 meq/g, at least 0.2 meq/g, at least 0.3 meq/g, at least 0.4 meq/g, 0.5 meq/g, at least 0.6 meq/g, at least 0.7 meq/g, at least 0.8 meq/g, at least 0.9 meq/g, at least 1 meq/g, at least 2 meq/g, at least 3 meq/g, at least 4 meq/g, at least 5 meq/g, at least 6 meq/g, at least 7 meq/g, at least 8 meq/g, at least 9 meq/g, or at least 10 meq/g of chemical agent.

In some embodiments of such an article, the chemical agent disposed upon the release layer is selected from the group consisting of GP-4 (a compound of formula I wherein $R{=}(CH_2)_3$, x=58 and y=4), GP-6 (a compound of formula I wherein $R{=}(CH_2)_3$, x=100 and y=4), GP-316 (a compound of formula III wherein $R{=}(CH_2)_3$, $R'{=}(CH_2)_2$, x=400 and y=8), GP-345 (a compound of formula III wherein $R{=}(CH_2)_3$, $R'{=}(CH_2)_2$, x=800 and y=2), GP-581 (a compound of formula I wherein $R{=}(CH_2)_3$, x=118 and y=11), GP-965 (a compound of formula II wherein $R{=}R'{=}(CH_2)_3$, x=10), KF-861 (a compound of formula III having an amine number of about 127), KF-864 (a compound of formula I having an amine number of about 27-30), KF-869 (a compound of formula III having an amine number of about 54), Silamine® A0 EDA (a compound of formula III wherein R=$(CH_2)_3$, R'=$(CH_2)_2$, having an amine number of about 230), Silamine® D2 EDA (a compound of formula III wherein R=$(CH_2)_3$, R'=$(CH_2)_2$, having an amine number of about 230-250 and an average MW of about 1,700), Silamine® D208 EDA (a compound of formula III, wherein part of the dimethyl siloxane repeating units are further substituted by polyether groups and wherein R=$(CH_2)_3$, R'=$(CH_2)_2$, the compound having an amine number of about 20-40 and an average MW of about 2,500), X-22 3939A (a compound of formula I wherein part of the dimethyl siloxane repeating units are further substituted by polyether groups, the compound having a reactive group equivalent weight of 1,700 g/mol, commercial and synthetic alternatives thereof, and mixtures thereof.

In some embodiments of such an article, the concentration of the chemical agent disposed on the release layer is not more than 1000 milligrams per square meter (mg/$m^2$), not more than 500 mg/$m^2$, not more than 400 mg/$m^2$, not more than 300 mg/$m^2$, not more than 200 mg/$m^2$, not more than 100 mg/$m^2$, not more than 50 mg per square meter, not more than 40 mg/$m^2$, not more than 30 mg/$m^2$, not more than 20 mg/$m^2$, not more than 10 mg/$m^2$, not more than 5 mg/$m^2$, not more than 4 mg/$m^2$, not more than 3 mg/$m^2$, not more than 2 mg/$m^2$, not more than 1 mg/$m^2$, or not more than 0.5 mg/$m^2$.

There is also provided, in accordance with an embodiment of the invention, a printed ink image on a substrate, the printed ink image comprising a water-soluble or water-dispersible polymeric resin, wherein at least one of the following is true: (1) the image has been printed by a printing method in accordance with an embodiment of the invention in which a chemical agent as described herein is applied to a hydrophobic release layer of an intermediate transfer member; (2) the image has on its outer surface distal to the substrate an amine functionalized silicone containing at least 0.3 wt. % of one or more chargeable nitrogen atoms and which amine functionalized silicone is further characterized by at least one of the following: (a) at least 33 wt. % silicon, (b) an amine number of at least 7 (c) an amine number of not more than 1000, preferably not more than 300, (d) a molecular weight of not more than 1,000,000, preferably not more than 50,000 (e) a molecular weight of at least 500, (f) no more than one hydroxyl or alkyoxy group per molecule of amine functionalized silicone, (g) a viscosity of at least 10 square millimeters per second ($mm^2$/s) (centiStokes), (h) a viscosity of not more than 1,000,000, preferably not more than 100,000 $mm^2$/S; (3) the ratio of the surface concentration of nitrogen at the outer surface of the image distal to the substrate to the bulk concentration of nitrogen within the image is at least 1.2:1, at least 1.3:1, at least 1.5:1, at least 1.75:1, at least 2:1, at least 3:1, or at least 5:1. ratio being at least 1.2:1, at least 1.3:1, at least 1.5:1, at least 1.75:1, at least 2:1, at least 3:1, or at least 5:1; (5) the ratio of the surface concentration of silicon at the outer surface of the image distal to the substrate to the bulk concentration of silicon within the image is at least 1.2:1, at least 1.3:1, at least 1.5:1, at least 1.75:1, at least 2:1, at least 3:1, or at least 5:1. ratio being at least 1.2:1, at least 1.3:1, at least 1.5:1, at least 1.75:1, at least 2:1, at least 3:1, or at least 5:1 (6) the atomic surface concentration ratio of nitrogen to carbon (N/C) at the image surface distal to the substrate to the atomic bulk concentration ratio of nitrogen to carbon (N/C) at a depth of at least 30 nm below the surface of the image, is at least 1.1:1, at least 1.2:1, at least 1.3:1, at least 1.5:1, at least 1.75:1, or at least 2:1; (7) the surface concentration of secondary amines, tertiary amines, and/or an ammonium group at the image surface distal to the substrate exceeds their respective bulk concentrations at a depth of at least 30 nanometers below the surface. In some embodiments, the chemical agent on the printed ink image contains one or more chargeable nitrogen atoms.

In some embodiments, the chemical agent on the printed ink image has an average molecular weight of at least 500, at least 800, at least 1,000, at least 1,300, at least 1,700, at least 2,000, at least 2,500, at least 3,000, at least 3,500, at least 4,000, at least 4,500, at least 5,000, of at least 10,000, at least 15,000, at least 20,000, at least 25,000, or at least 50,000. In some embodiments, the chemical agent has an average molecular weight of at most 100,000, at most 50,000, at most 25,000, at most 20,000, at most 15,000, at most 10,000, at most 5,000, at most 4,500, at most 4,000, at most 3,500, at most 3,000, or at most 2,500. In some embodiments, the chemical agent on the printed image has an average molecular weight in the range of 550 to 90,000, e.g., 600 to 80,000, 700 to 70,000, 900 to 60,000, 950 to 45,000, 1,050 to 40,000, 1,100 to 30,000, 1,200 to 26,000, 1,300 to 21,000, 1,400 to 19,000, 1,600 to 18,000, or 2,000 to 16,000.

In some embodiments, the positive charge density of the chemical agent on the printed image is at least 0.1 meq/g, 0.2 meq/g, 0.3 meq/g, 0.4 meq/g, 0.5 meq/g, 0.6 meq/g, 0.7 meq/g, 0.8 meq/g, 0.9 meq/g, at least 1 meq/g, at least 2 meq/g, at least 3 meq/g, at least 4 meq/g, at least 5 meq/g, 6 meq/g, at least 7 meq/g, at least 8 meq/g, at least 9 meq/g, or at least 10 meq/g of chemical agent.

In some embodiments the polymer on the printed image is selected from the group consisting of GP-4, GP-6, GP-316, GP-345, GP-581, GP-965, KF-861, KF-864, KF-869, Silamine® A0 EDA, Silamine® D2 EDA, Silamine® D208 EDA, X-22 3939A, commercial alternatives thereto, and mixtures thereof.

In some embodiments, a surface concentration of nitrogen at the surface distal to the substrate on which the printed ink image rests exceeds a bulk concentration of nitrogen within the bulk of the ink image, the bulk concentration being measured at a depth of at least 30 nanometers, at least 50 nanometers, at least 100 nanometers, at least 200 nanometers, or at least 300 nanometers below the ink image surface distal to the substrate, and the ratio of the surface concentration to the bulk concentration is at least 1.1 to 1. In some embodiments, the bulk concentration is measured at a depth of at least 30 nm from the ink image surface distal to the substrate. In some embodiments, a surface concentration of silicon at the surface distal to the substrate on which the printed ink image rests exceeds a bulk concentration of silicon within the bulk of the ink image, the bulk concentration being measured at a depth of at least 30 nanometers, at least 50 nanometers, at least 100 nanometers, at least 200 nanometers, or at least 300 nanometers below the ink image surface distal to the substrate, and the ratio of the surface concentration to the bulk concentration is at least 1.1 to 1. In some embodiments, the bulk concentration is measured at a depth of at least 30 nm from the ink image surface distal to the substrate.

DETAILED DESCRIPTION

As mentioned above, the presently claimed invention pertains to a particular aspect of a novel printing process and apparatus for indirect digital inkjet printing using aqueous inks Briefly, the printing process comprises directing droplets of an aqueous inkjet ink onto an intermediate transfer member having a hydrophobic release layer to form an ink image on the release layer, the ink including a negatively charged or chargeable polymeric resin and a colorant in an aqueous carrier. The term "release layer" is used herein to denote the hydrophobic outer surface of the intermediate transfer member, and while in some instances that outer surface may be part of a layer that is readily distinguishable from the rest of the intermediate transfer member, in theory it is possible that the intermediate transfer member has a uniform construction, in which case the outer surface will not, strictly speaking, be part of a separate layer. Upon impinging upon the intermediate transfer member, each ink droplet in the ink image spreads to form an ink film having a pancake-like structure. The ink is then dried while the ink image is on the intermediate transfer member, generally while being transported by the intermediate transfer member, by evaporating the aqueous carrier from the ink image to leave a residue film of resin and coloring agent. The residue film is then transferred to a substrate.

As noted, upon impinging upon the surface of the intermediate transfer member, each ink droplet tends to spread out into a pancake-like structure due to the kinetic energy of the droplet itself. However, because the ink used in the process described above is aqueous, but the release layer of the intermediate transfer member is hydrophobic, the ink droplets tend to bead on the transfer member. The term "to bead" is used herein to describe the action of surface tension to cause a pancake or disk-like film to contract radially and increase in thickness so as to form a bead, that is to say a near-spherical globule. The tendency of an impinging droplet to retain disk-like shape or regain globule-like form depends upon various factors, including for instance the chemical compositions of the ink and of the surface of the intermediate transfer member. The present disclosure relates to a chemical agent which can be applied to the release layer (e.g., in the form of a conditioning liquid) prior to jetting of the ink so as to counteract the tendency of the ink film produced by each droplet to bead under the action of the surface tension of the aqueous carrier, without causing each droplet to spread by wetting the surface of the intermediate transfer member. The chemical composition of this chemical agent or conditioning liquid desirably "bridges" between the ink and the transfer member enabling the jetted ink droplet to retain pancake shape, at least for the duration of ink carrier evaporation. Thus the chemical compositions of the ink and of the chemical agent which is applied to the surface of the intermediate transfer member are selected so as to counteract the tendency of the ink film produced by each droplet to bead under the action of the surface tension of the aqueous carrier, without causing each droplet to spread by wetting the surface of the intermediate transfer member. Without wishing to be bound by theory, it is presently believed that, in the case of the presently claimed invention, this is due to mutually attractive intermolecular forces between ink molecules in the region of each droplet nearest the surface of the intermediate transfer member and molecules on the surface of the intermediate transfer member itself, the latter molecules resulting from the application of the chemical agent.

In the context of this patent application, "chargeable nitrogen atom" refers to both a nitrogen atom which may be positively charged at acidic pH, such as a primary, secondary or tertiary amine nitrogen atom, which as is known in the art function as Brønsted bases to abstract a proton from a Brønsted acid to form the corresponding ammonium cation, as well as to a quaternary ammonium ion, which bears a permanent positive charge. In the context of this patent application, when referring to the chemical agent, "positive charge density of X" means the chemical agent has X milliequivalents of charge per gram of chemical agent at pH 4.5.

A hydrophobic outer surface on the intermediate transfer member is desirable as it assists in the eventual transfer of the residue film to the substrate. Such a hydrophobic outer surface or release layer is however undesirable during ink image formation, among other reasons because bead-like ink droplets cannot be stably transported by a fast moving intermediate transfer member and because they result in a thicker film with less coverage of the surface of the substrate. The presently claimed invention sets out to preserve, or freeze, the thin pancake shape of each ink droplet, that is caused by the flattening of the ink droplet on impacting the surface of the intermediate transfer member, despite the hydrophobicity of the surface of the intermediate transfer member, while also facilitating transfer of the ink droplet so frozen to a substrate.

Although so-called "wetting agents", viz. agents that reduce the surface tension of ink droplets on a particular surface, are known in the art for use with other types of transfer members or for use with non-aqueous inks on hydrophobic surfaces, these are often unsatisfactory in the contexts in which they are used and unsatisfactory for use with the combination of aqueous inks on hydrophobic transfer member surfaces. Inter alia, the use of wetting agents can result in droplets on the surface of the transfer member that undesirably spread or have rough edges, which results in a printed substrate of less than ideal quality.

The present invention facilitates printing using an aqueous ink and an intermediate transfer member having a hydrophobic surface, by applying to the surface of the transfer member to which the ink is applied—i.e. by applying to the hydrophobic release layer—a small amount, preferably in the form of a thin layer, of chemical agent that reduces the tendency of the aqueous inkjet ink droplet that has been printed onto the release layer to contract. Measurements will show that the contact angle of water on a hydrophobic release layer so treated remains high, indicating that, in contrast to wetting agents, treatment with the chemical agent does not result in a loss of surface tension. Therefore, the chemical agent of the present disclosure advantageously reduces droplet contraction, without causing an undesired spreading of the droplet much beyond its initial impact pancake shape. Electron micrographs of aqueous inkjet inks jetted onto a release layer so treated, then dried while still on the release layer and then transferred to a paper substrate will show that the edges of such ink droplets are sharper than the edges of ink droplets transferred to paper by other means. The chemical agent thus fixes the ink film to the release layer, although it will be appreciated that such fixation is weaker than the subsequent adhesion of the resin in the ink film residue to the substrate. Non-limiting examples of release layers and intermediate transfer members for which the present invention can be suitable are disclosed in PCT Publication No. WO 2013/132432.

Application of the chemical agent in accordance with some embodiments of the invention results in positive charge on at least portions of the release layer. This may be achieved, for example, by applying to the surface of the intermediate transfer member molecules having one or more Brønsted base functional groups and in particular nitrogen-containing molecules, under conditions in which the molecules bear positive charge. Suitable positively charged or chargeable groups include primary amines, secondary amines, tertiary amines, and quaternary ammonium moieties, and the chemical agent may contain more than one such group. In some embodiments, the amines are primary amines, which means that they are located at termini of the silicone polymers (either backbone termini or side-chain termini) to which they are covalently bound. Without wishing to be bound by theory, it is surmised that placing the amines, primary or otherwise, in such positions facilitates emulsion formation in water, by enabling the formation of droplets having an outer amine-containing portion facing the water, with the hydrophobic carbon and silicon-containing portions facing the interior the droplets. Also, without wishing to be bound by theory, it is surmised that when the release layer is silicon-based, some of the chemical agent may penetrate into the release layer, due to similarity in the composition of the chemical agent molecules and the release layer, particularly when the molecular weight of the chemical agent is relatively low or the cross-linking density in the release layer is insufficiently high; evidence for such penetration may be obtained by measuring swelling of the release layer. It will be appreciated that the chemical agent should be chosen to withstand the temperature at which the printing process is carried out (see detailed description of such a process below), at least for a time sufficient to allow jetting and drying of the ink on the dried chemical agent, a period of time which is usually on the order of a few seconds.

Positively chargeable amine groups of the molecules on the release layer may interact with negatively charged functional groups of molecules of the ink. Suitable negatively charged or negatively chargeable groups include carboxylic acid groups (—COOH), including acrylic acid groups ($—CH_2=CH—COOH$) and methacrylic acid groups ($—CH_2=C(CH_3)—COOH$), and sulfonic acid groups ($—SO_3H$). Such groups can be covalently bound to polymeric backbones; for example styrene-acrylic copolymer resins have carboxylic acid functional groups which readily lose protons to yield negatively-charged moieties. Suitable ink molecules may also include hydroxyl groups (—OH), for example linear and branched polyester-polyols and copolyester resins. Non-limiting examples of ink compositions for which the present invention can be suitable are water based inks as disclosed in PCT Publication No. WO 2013/132439 and in co-pending U.S. Application No. 61/876,727, filed on Sep. 11, 2013.

The contacting of the surface of the intermediate transfer member with a positively charged conditioning/treatment liquid (e.g., an emulsion) can be viewed as applying molecules that become non-covalently associated with the surface of the intermediate transfer member and present a net positive charge with which some of the negatively charged molecules in the ink may interact. It will be appreciated that the non-covalent association between the chemical agent and the release layer should preferably be formed quickly, for example by electrostatic attraction between the charged nitrogen atoms and hydroxyl groups present in the release layer as a result of the condensation reaction employed to form the release layer, but that the strength of this attraction should be less than the attraction between the chemical agent and the ink and the attraction between the ink the substrate. However, the inventors do not wish to be bound by theory, as it has been found that in cases in which such hydroxyl groups are not present in the release layer, for example, when the release layer has been formed by an addition reaction rather than by condensation, good coverage of the release layer and transfer of ink to the substrate is also achieved.

Thus, among the factors to be taken into account in selecting the chemical agent for use in treating the release layer, charge density, amine number and molecular weight are parameters to take into consideration. In cases in which the positive charge is provided by protonation of nitrogen atoms (or by the presence of quaternary ammonium ions), the percentage of nitrogen atoms in the polymer as a function of the weight of the polymer may serve as a proxy for charge density. Thus, for example, it has been found that an oil-in-water emulsion of GP-965 amine functional silicone fluid (Genesee Polymers Corporation, Burton, Mich.), which has a molecular weight of 990 but an amine number of 200, works roughly as well at the same concentration as an oil-in-water emulsion of Genesee's GP-4 amine functional silicone fluid, which has a molecular weight of about 4,932 but an amine number of 90. Similarly, Genesee's GP 316, which has an amine number of 54 but a MW of 31,106, and GP 6, which has an amine number of 49 and a MW of 8,046 also seem to work equally well. Additional compounds are described in the Example section that follows. In the present application, "amine number" refers to the number of milliliters of 0.1N HCl needed to neutralize 10 g of the amine functionalized polymer. Preferably, the chemical agent should be able to quickly (i.e. in under a second from application to the release layer, e.g., in 0.5, 0.1, 0.05, 0.01, 0.005 or 0.001 seconds or less, and preferably instantaneously) associate itself with the release layer.

In some embodiments, the conditioning agent or liquid is applied to the release layer of the transfer member at each print cycle, a cycle being defined as the duration needed for a point on the blanket to move along its path from a specific station (e.g., the image forming station) to the same station having completed a full round in the printing system. In alternative embodiments, the chemical agent or conditioning liquid comprising this agent are applied to the release layer every few cycles (e.g., once every 10-20 cycles, once in up to 50, or once in up to 100 cycles.

As noted above, the hydrophobic release layer of the intermediate transfer member may be silicon-based, e.g., the product of cross-linking by condensation of a silanol-terminated polydialkylsiloxane, such as a polymer of formula (IV):

IV

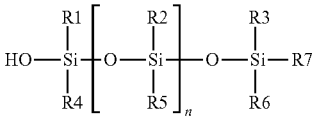

where $R^1$ to $R^6$ are each independently a $C_1$ to $C_6$ hydrocarbon group (saturated or unsaturated, linear or branched), $R^7$ is selected from the group consisting of OH, H or a $C_1$ to $C_6$ hydrocarbon group (saturated or unsaturated, linear and/or branched); and n is an integer from 50 to 1,000. In some cases, n is an integer between 200 and 350. In some instances, the silicone has a molecular weight of between 10,000 and 50,000 or 15,000 to 26,000, e.g., 16,000 to 23,000, prior to crosslinking. In one example of such a material, the silicone is a silanol-terminated polydimethylsiloxane, i.e. $R^1$ to $R^6$ are all $CH_3$ and $R^7$=OH. The crosslinker, which may be present in an amount between e.g., 5 to 20 wt. %, such as 9 to 12 wt. %, relative to the polymer prior to crosslinking, may be an oligomeric condensate of a polyethylsilicate monomer, such as PSI023 (Gelest) or Ethylsilicate 48 (Colcoat). Preferably the silicone polymer is made by condensation curing. Intermediate transfer members or release layers thereof comprising such condensation cured polydialkyl siloxanes may hereinafter be referred to as CCRL.

Alternatively, the hydrophobic release layer of the intermediate transfer member may be a silicon-based layer produced by cross-linking effected by addition curing, e.g., the addition curing of a vinyl functional polydialkysiloxane (such as a compound of formula V or VI, as shown below) to a hydride functional polydialkylsiloxane, i.e. a crosslinker (such as a compound of formula VII or VIII or IX, as shown below):

V

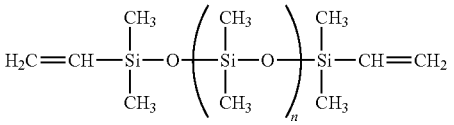

where n is an integer between 150 and 2,000, and in some cases from 350 to 1,650;

and the vinyl content varies from 0.010 meq/g to 0.15 meq/g;

VI

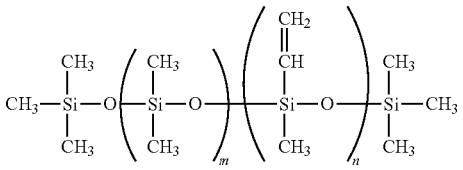

Intermediate transfer members or release layers thereof comprising such addition cured vinyl functional polydialkyl siloxanes may hereinafter be referred to as ACRL. The viscosity of the polymer before cross-linking may range from e.g., 100 mPa·s to 10,000 mPa·s, and the vinyl content before cross linking may vary from e.g., 0.125 meq/g to 2 meq/g. Such a reaction may be catalyzed by platinum complexes, such as platinum divinyltetramethyldisiloxane complex, CAS number 68478-92-2, available for example (a) as a 3-3.5% platinum concentration in vinyl-terminated polydimethylsiloxane, 200 $mm^2/s$, under the name SIP6830.3 from Gelest Inc., Morrisville, Pa. USA, (b) or in xylene, under the name SIP6831.2 from Gelest, (c) in vinyl silicone polymer under the names Catalyst 510 or Catalyst 520 from Evonik Hanse, and proceeds faster at higher temperatures. Like the silanol terminated polydimethylsiloxane used in condensation curing, the vinyl functional polydimethylsiloxane may be a vinyl-terminated polydimethylsiloxane, such as Gelest DMS-V grade polymers DMS-V31, DMS-V35, and DMS-V46, (all being of formula V above and having CAS number 68083-19-2 but varying in their MW from 186 to 155,000 and ranging in viscosity from 1,000 $mm^2/s$ to 60,000 $mm^2/s$ viscosity); or it may have vinyl group pendant from the backbone of the polymer, such as VDT-131 or VDT-431 from Gelest, both being of formula VI above, having CAS number 67762-94-1, and a viscosity of 800-1200 mm2/s, the former having 0.8-1.2 mole % vinylmethylsiloxane, the latter having 4.0-5.0 mol % vinylmethylsiloxane; or Polymer XP RV 200 or XP RV 5000 from Evonik Hanse, both of which contain both terminal and pendant vinyl groups. The vinyl functional polydialkyl siloxane may be also be a branched structure vinyl functional polydimethyl siloxane, such as Gelest VQM Resin-146, CAS number 68584-83-8, having the structure VI A:

VI A.

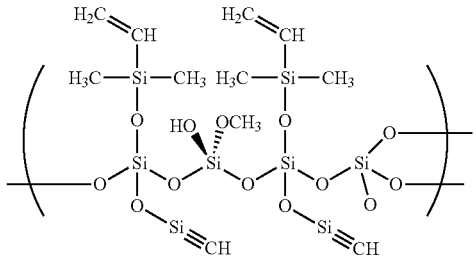

The hydride functional polydialkylsiloxane used as a cross-linker is generally a low viscosity copolymer (15-1000 mPa·s). The hydride may be at the end of the polymer chain or pendant in the chain, as shown in formulae VII and VIII:

VII

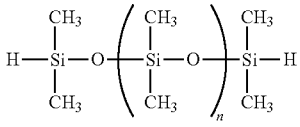

where n is an integer between 4 and 400, and

VIII

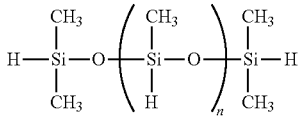

where n is an integer between 20 and 40. The hydride functional polydialkylsiloxane can be also a copolymer of formula IX:

IX

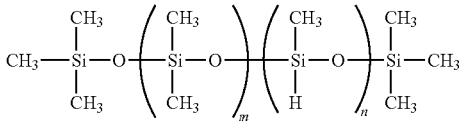

where m=10-80 and n=2-15, i.e. a as a trimethylsiloxy-terminated methylhydrosiloxane-dimethyisiloxane copolymer such as Gelest HMS grade.

In order to obtain acceptable cross-linking, there should be a molar excess of hydride moieties to vinyl moieties, i.e. the molar ratio between hydride moieties and vinyl moieties should be higher than 1:1, preferably higher than 1.5:1 but lower than 3:1. It will be appreciated that in order to achieve such a ratio of hydride to vinyl moieties, the molar ratio of hydride-containing molecules to vinyl-containing molecules may vary, depending on the structure of the molecule. For the same value of n, for example, the number of hydride groups in a molecule of formula VIII will be greater than the number of hydride groups in a molecule of formula VII, even though the molecule of formula VIII will have a lower molecular weight than then molecule of formula VII. Similarly, for most values of n, a molecule of formula VI will have a greater number of vinyl groups per molecule than a molecule of formula V. Thus, for a given value of n, a molecule of formula V and a molecule of formula VII will present the same number of vinyl and hydride moieties, respectively, but a molecule of formula V will present significantly fewer vinyl moieties than a molecule of formula VIII presents vinyl moieties.

Non-limiting examples of aqueous inkjet inks suitable for use in conjunction with embodiments of the present invention are described in WO 2013/132439 and in the co-pending PCT application of the Applicant claiming priority from U.S. 61/876,727, filed on Sep. 11, 2014, which is incorporated herein by reference. Such inks contain water-soluble or water-dispersible colorants, e.g., dyes or nano pigments, and a water-dispersible or water-soluble polymeric resin. As noted above, such resins, such as styrene-acrylic copolymers, may contain moieties such as free carboxyl groups that are negatively chargeable (i.e. they have protons which they will readily give up) and are generally negatively charged under the conditions of use (e.g., at alkaline pH). An example of a suitable ink formulation is described below. Other resins may suitably provide negatively charged inks under operating conditions, including for example polyols. It has been found that contacting the hydrophilic release layer with a small amount of positively charged polymeric material (i.e. conditioning agent) so that the positively charged material is disposed thereupon (e.g., as a thin layer) suitably reduces the tendency of the aqueous inkjet ink droplet that has been jetted onto the release layer to contract. In this connection, it should be noted that not all positively-charged materials are suitable to this end. For example, low molecular weight quaternary amines were found to provide little improvement in the transfer of the dried ink image to a paper substrate, whereas polymeric compounds containing amines significantly improved such transfer.

The chemical agent may be applied to the release layer as an oil-in-water emulsion, for example at a concentration of about 0.2-20 wt. %, e.g., 20 wt. %, 10 wt. %, 5 wt. %, 4 wt. %, 3 wt. %, 2, wt. %, 1 wt. %, 0.5 wt. %, 0.3 wt. %, 0.2 wt. % or 0.1 wt. % or less of the chemical agent, preferably under conditions in which the chemical agent is positively charged, e.g., amine nitrogen atoms contained therein are in protonated form as the corresponding ammonium ions. The oil-in-water emulsion may be and preferably is heated to evaporate the water prior to the ink image formation, whereby the ink droplets are directed onto a substantially dry surface. Furthermore, it is only necessary to apply a sufficient amount of the chemical agent so that, once dry on the release layer, the chemical agent will retard the contraction of aqueous inkjet ink droplets that have been jetted on the release layer, without substantially affecting the release properties of the release layer. The chemical agent so applied and dried may thus form a thin layer (e.g., up to 1 μm depending on the viscosity of the conditioning agent prior to drying), preferably not more than a few nanometers thick (e.g., not more than 500 nm or not more than 100 nm). In some embodiments, the chemical agent on which ink has been jetted will transfer with that ink to the substrate, forming a sandwich in which the chemical agent rests on the ink which lies on the substrate. Since the ink itself will typically form a layer having a thickness several orders of magnitude greater than that of the chemical agent (e.g., ~400-600 nm thickness after drying), the presence of a layer of chemical agent a few nanometers thick on ink on the substrate will not appreciably affect the properties of that ink, such as glossiness or optical density. This is another reason why the amount of chemical agent should ideally be kept to a minimum: an unnecessarily large amount of the chemical agent present on the release layer may result in excess chemical agent on the ink that is transferred to the substrate. Moreover, since even under ideal circumstances some of the chemical agent may remain on the release layer, the avoidance of use of excess chemical agent will minimize the build-up of such agent on the release layer, and will lengthen the time required between cleanings of the release layer, if needed.

Conditioning liquids (e.g., emulsions) containing the chemical agent may be applied to the release layer in a manner known in the art for applying liquids to solid surfaces, such as by spraying or by use of a roller or by use of an application cloth; it is preferable that the chemical agent be applied evenly to the release layer or evened out after application and before jetting of the ink, preferably before drying of the chemical agent. Methods known in the art for regulating the thickness of such a liquid layer may be utilized, and additional machinery may be employed to this end. In some embodiments, the chemical agent is applied to the release layer by undulations from a fountain or spraying or contacting a liquid film overlying an applicator and then evened using a metering roller or removed from the transfer member shortly following its exposure thereto (e.g., by wiping or using an air flow or squeegee rollers). In some embodiments it is sufficient that after removal of the water, the chemical agent be present in a layer of a few molecules' thickness or even a mono layer.

Although in principle the aqueous inkjet ink may be jetted onto the chemical agent-coated release layer while the chemical agent is still in the emulsion, in practice the chemical agent will generally be dry prior to the jetting of the ink, as the release layer will generally be heated, resulting in drying of the emulsion before jetting of the ink occurs, so that the ink droplets are directed onto a substantially dry surface.

The ratio of charges in the ink droplet to the charges in the region of the chemical agent upon which the ink droplet rests may be small, but this need not be the case. Assuming an initial layer of chemical agent-containing solution of 1 micrometer thickness containing 2 wt. % of the chemical agent, 1 square meter of release layer is therefore coated by 1 ml of conditioning liquid, hence contains about 1 g of chemical agent emulsion or, after drying, 20 mg of dry chemical agent. Assuming an ink containing 7.5 wt. % charged resin and a single ink drop of 12 picoliter volume having a 30 micrometer radius upon impact on the release layer, then the area covered by this drop will be approximately $2.83\times10^{-9}$ square meters, so that one drop of ink covers 56.5 picograms of the chemical agent. If the chemical agent has a charge density of 6 milliequivalents per gram, then one drop of ink covers $3.39\times10^{-13}$ amines of the chemical agent. Since the one drop of the present exemplary calculation has a mass of 12 ng and contains 7.5 wt % of resin, it contains 0.9 nanograms of resin. If the resin has acid number 86 mg KOH/g then its charge density is 1.53 meq/g, thus it contains 1.38 picoequivalents of carboxyl groups, giving a carboxyl/amine ratio of approximately 4. Using this same calculation, if one assumes an ink drop of the same volume and resin concentration but having a charge density of 12 meq/g, i.e. twice the charge density, then the carboxyl/ amine ratio would be 8. Similar calculations can be made for different charge densities of the chemical agent, e.g., if the charge density of the chemical agent is 18, and the other parameters are assumed to be the same.

The calculations in the previous paragraph indicate that any interaction between negative charges in the resin in the ink and positive charges in the chemical agent on the release layer cannot be stoichiometric.

As the amount of charge on the transfer member is too small to attract more than a small number of charged resin particles in the ink, it is believed that the concentration and distribution of the charged resin particles in the drop is not substantially changed as a result of contact with the chemical agent on the release layer.

Chemical agents in accordance with embodiments of the present invention may also be characterized by their effect on the contact angle of water. When the hydrophobic release layer is coated with a layer of chemical agent in accordance with embodiments of the invention, the contact angle of a drop of distilled water on the hydrophobic release layer should not significantly change in comparison to a drop of water on an uncoated layer, which indicates that the surface energy, and thus the surface tension of the water droplet, is essentially unaffected by the chemical agent. Thus contact angle measurements show that amine silicones, which do not have the structure of surfactants and for which the hydrophilic-lipophilic balance (HLB) cannot be measured, do not act like wetting agents. This is in contrast to the action of conventional wetting agents as used in prior art processes, which by definition affect the surface energy of the transfer surface and give rise to droplets having significantly lower contact angles. It will also be appreciated that the effect of some conventional wetting agents on the hydrophobic release layer were tested with aqueous ink as herein disclosed and found to yield transfer to a paper substrate that was no better than if the release layer had been untreated.

It has been found, surprisingly, that the application of a chemical agent to a hydrophobic release layer in accordance with embodiments of the invention has a profound effect on the shape of the ink droplets after the droplets stabilize. To revert from a pancake or disk-like shape to a spherical globule, surface tension needs to peel the surface of the ink droplet away from the surface of the intermediate transfer member. However, within the time frame of the printing process described herein i.e. several seconds from the jetting of the ink onto the intermediate transfer member until the solvent is evaporated from the ink and the ink is then transferred to the substrate the ink droplet does not revert from a pancake back to a globule on release layers coated with the chemical agent. Without wishing to be bound by theory it is believed that the intermolecular forces between the chemical agent on the release layer and the resin in the ink resist such separation of the surface of the droplet from the surface of the release layer, resulting in a relatively flat droplet of ink which remains flatter to a significantly greater extent than a droplet of the same volume deposited on the same surface without such conditioning. Furthermore, since in areas that are not reached by the droplet the effective hydrophobic nature of the transfer member is maintained, there is little or no spreading of the droplet above that achieved in the initial impact and the boundaries of the droplet are distinct; in other words there is no wetting by the ink droplets of the surface of the intermediate transfer member, thus resulting in droplets having a regular rounded outline.

In some embodiments of the invention, the intermediate transfer member is a flexible blanket of which the outer surface is the hydrophobic outer surface upon which the ink image is formed. The blanket may form an elongated strip and be attached to itself at its ends to form a continuous endless belt. It is however alternatively possible for the intermediate transfer member to be constructed as a drum.

In accordance with a feature of some embodiments of the invention, prior to transferring the residue film onto the substrate, the ink image is heated to a temperature at which the residue film of resin and coloring agent that remains after evaporation of the aqueous carrier is rendered tacky (e.g., by softening of the resin). The temperature of the tacky residue film on the intermediate transfer member may be higher than the temperature of the substrate, whereby the residue film cools during adhesion to the substrate.

By suitable selection of the thermo-rheological characteristics of the residue film the effect of the cooling may be to increase the cohesion of the residue film, whereby its cohesion exceeds its adhesion to the transfer member so that, when brought into contact with the substrate e.g., at an impression station (see below), for which it has greater affinity than for the release layer, substantially all of the residue film is separated from the intermediate transfer member and impressed as a film onto the substrate. In this way, it is possible to ensure that the residue film is impressed on the substrate without significant modification to the area covered by the film nor to its thickness.

Upon transfer of the ink image from the release layer to the substrate, some, and in some cases most or even nearly all, of the chemical agent upon which ink has been jetted will transfer with the image to the substrate, resulting in an ink image on the substrate having a thin (e.g., 1-10 nm thick) layer of the chemical agent thereupon. As will be appreciated by persons skilled in the art, the presence of the chemical agent may be detected through various methods, such as X-ray photoelectron spectroscopy.

The ink used in conjunction with the chemical agent on the release layer preferably utilizes an aqueous carrier, which reduces safety concerns and pollution issues that occur with inks that utilize volatile hydrocarbon carrier. In general, the ink must have the physical properties that are needed to apply very small droplets close together on the transfer member.

Other effects that may contribute to the shape of the droplet remaining in the flattened configuration are quick heating of the droplets to increase their viscosity; the presence of a polymeric conditioning agent that reduces the hydrophobic effect of the silicone-based outer release layer; and the presence in the ink of a surfactant that reduces the surface tension of the ink.

In general, ink jet printers require a trade-off between purity of the color, the ability to produce complete coverage of a surface and the density of the ink-jet nozzles. If the droplets (after beading) are small, then, in order to achieve complete coverage, it is necessary to have the droplets close together. However, it is very problematic (and expensive) to have the droplets closer than the distance between pixels. By forming relatively flat droplet films that are held in place in the manner described above, the coverage caused by the droplets can be close to complete.

In some instances, the carrier liquid in the image is evaporated from the image after it is formed on the transfer member. Since the colorant in the droplets is distributed within the droplet, either as a solution (e.g., in the case of a dye) or as a dispersion (e.g., in the case of a pigment), the preferred method for removal of the liquid is by heating the image, either by heating the transfer member or by external heating of the image after it is formed on the transfer member, or by a combination of both. In some instances, the carrier is evaporated by blowing a heated gas (e.g., air) over the surface of the transfer member.

In some instances, different ink colors are applied sequentially to the surface of the intermediate transfer member and a heated gas is blown onto the droplets of each ink color after their deposition but before deposition on the intermediate transfer member of the next ink color. In this way, merging of ink droplets of different colors with one another is reduced.

In some instances, the polymer resin used in the ink is a polymer that enables the ink to form a residue film when it is heated (the term residue film is used herein to refer to the ink droplets after evaporation of the liquid carrier therefrom). Acrylic-styrene co-polymers with an average molecular weight around 60,000 and polyester-based resins having an average molecular weight around 2,600, for example, have been found to be suitable. Preferably all of the liquid in the ink is evaporated, however, a small amount of liquid, that does not interfere with the forming of a residue film may be present. The formation of a residue film has a number of advantages. The first of these is that when the image is transferred to the final substrate all, or nearly all, of the image can be transferred. This allows in some cases for a system without a cleaning station for removing residues from the transfer member. It also allows for the image to be attached to the substrate with a nearly constant thickness of the image covering the substrate. Additionally, it prevents the penetration of the image beneath the surface of the substrate.

In general, when an image is transferred to or formed on a substrate while it is still liquid, the image penetrates into the fibers of the substrate and beneath its surface. This causes uneven color and a reduction in the depth of the color, since some of the coloring agent is blocked by the fibers. In some instances, the residue film is very thin (e.g., less than 1 micrometer thick), preferably between 10 nm and 800 nm and more preferably between 50 nm and 500 nm. Such thin films are transferred intact to the substrate and, because they are so thin, replicate the surface of the substrate by closely following its contours. This results in a much smaller difference in the gloss of the substrate between printed and non-printed areas.

When the residue film reaches a transfer or impression station at which it is transferred from the intermediate transfer member to the final substrate, it is pressed against the substrate, having preferably previously been heated to a temperature at which it becomes tacky in order to attach itself to the substrate.

Preferably, the substrate, which is generally not heated, cools the image so that it solidifies and transfers to the substrate without leaving any of residue film on the surface of the intermediate transfer member. For this cooling to be effective, additional constraints are placed on the polymer in the ink.

The fact that the carrier is termed an aqueous carrier is not intended to preclude the presence of certain organic materials in the ink, in particular, certain innocuous water miscible organic material and/or co-solvents, such as ethylene glycol or propylene glycol.

As the outer surface of the intermediate transfer member is hydrophobic, there may be little (<1.5%) or substantially no swelling of the transfer member due to absorption of water from the ink; such swelling is known to distort the surface of transfer members in commercially available products utilizing silicone coated transfer members and hydrocarbon carrier liquids. Consequently, the process described above may achieve a highly smooth release surface, as compared to intermediate transfer member surfaces of the prior art.

As the image transfer surface is hydrophobic, and therefore not water absorbent, substantially all the water in the ink should be evaporated away if wetting of the substrate is to be avoided. It will be appreciated that the inclusion of certain co-solvents, such as ethylene glycol or propylene glycol, which have higher boiling points than water, may reduce the rate at which the solvent evaporates relative to the situation in which water is the only solvent. However, the ink droplets on the transfer member are of sufficiently small thickness relative to their surface area, and are usually heated at a temperature for a time, sufficient to allow for evaporation of substantially all of the solvent prior to transfer to the substrate.

DRAWINGS

Some embodiments of the invention will now be described further, by way of examples, and with reference to the accompanying drawings. The description, together with the figures, makes apparent to a person having ordinary skill in the art how some embodiments of the invention may be practiced. The figures are for the purpose of illustrative discussion and no attempt is made to show structural details of a printing system in which the presently claimed invention may be practiced or of any embodiment in more detail than is necessary for a fundamental understanding of the inventions. For the sake of clarity and convenience of presentation, some objects depicted in the figures are not necessarily shown to scale. In the figures:

Figure 5:
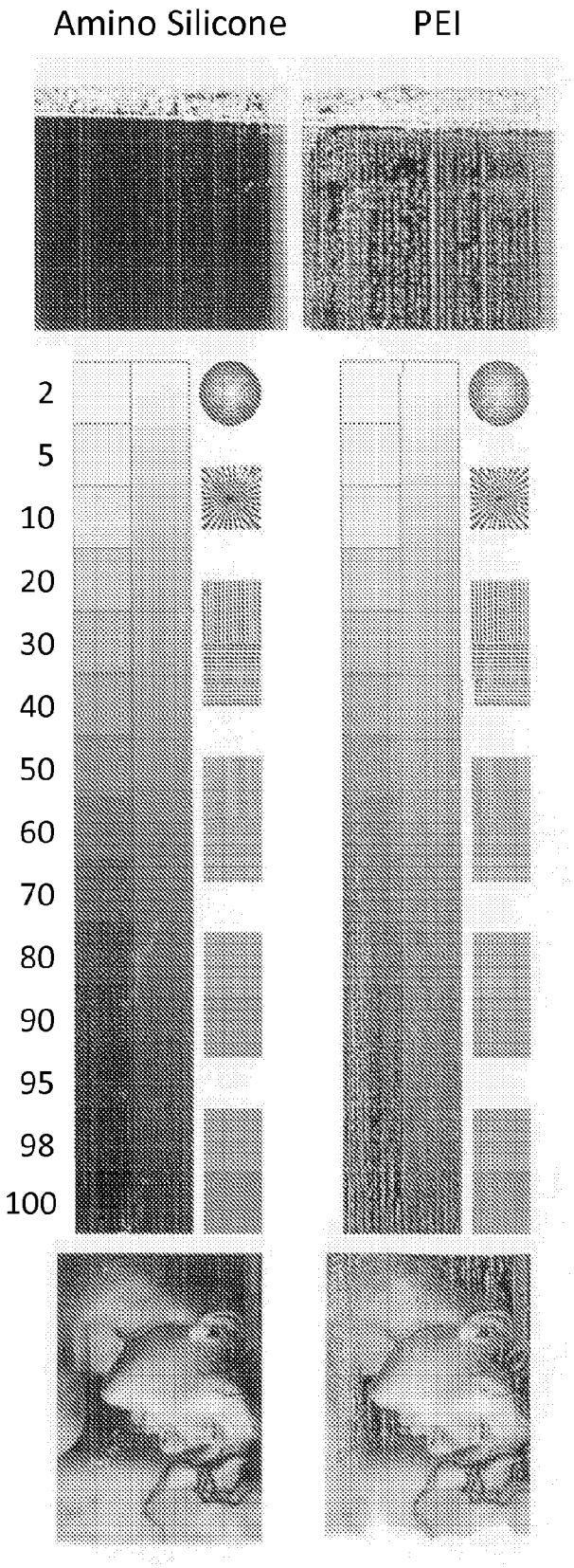
Figure 6:
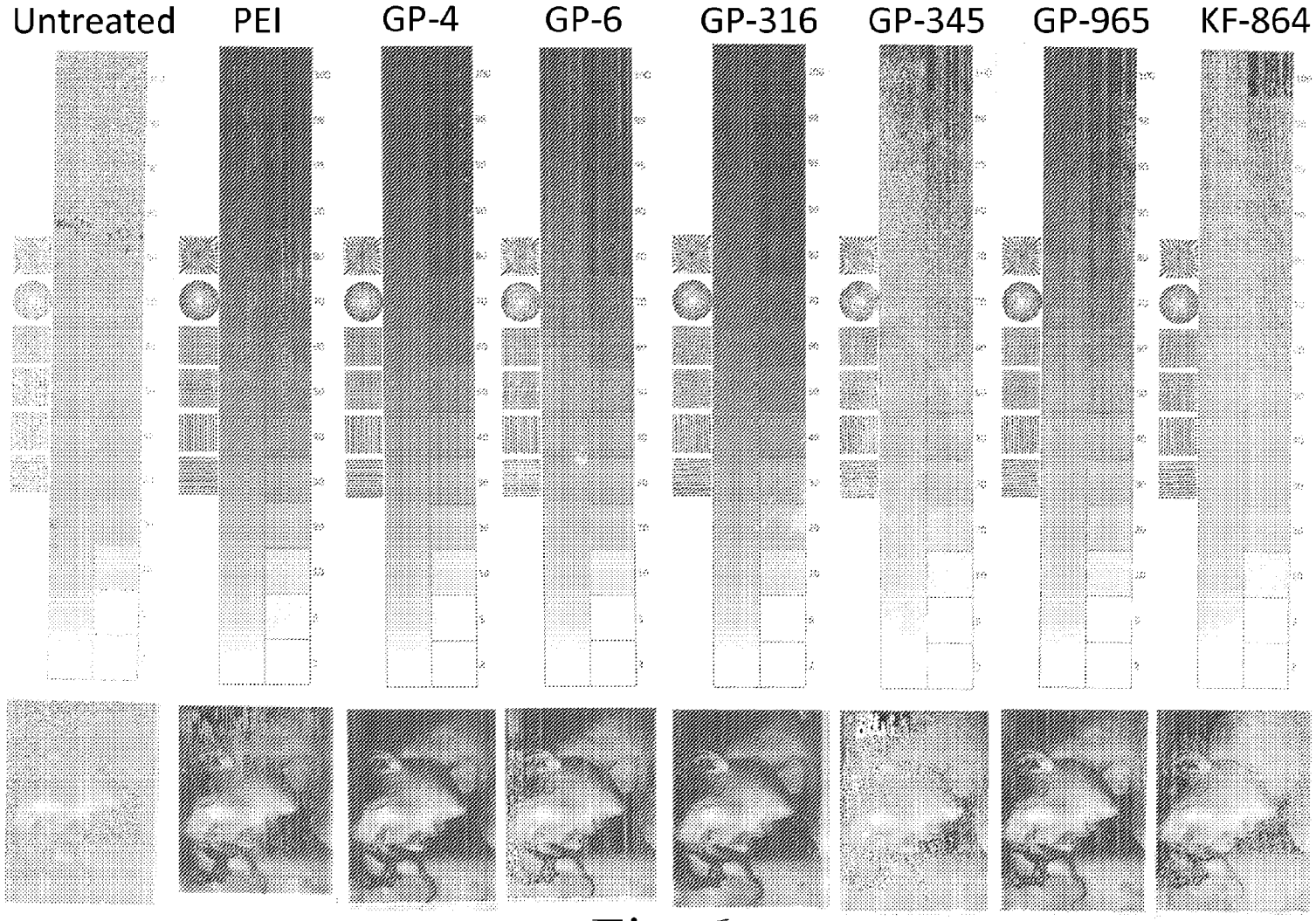

FIG. 5 shows a print-out of an ink image transferred from an intermediate transfer member treated according to an embodiment of the invention, the release layer being prepared by addition curing and the transfer being to coated paper; and FIG. 6 shows print-outs of an ink image transferred from an intermediate transfer member treated according to various embodiments of the invention, the release layer being prepared by condensation curing and the transfer being to coated paper.

The remaining Figures are scans of paper onto which ink was transferred from a hydrophobic release layer, illustrating the effects of contacting the release layer with different (or no) chemical agents prior to jetting of the ink onto the release layer.

GENERAL OVERVIEW OF THE PRINTING PROCESS AND SYSTEM

The printing systems schematically illustrated in FIGS. 1 and 2 essentially include three separate and mutually interacting systems, namely a blanket support system 100, an image forming system 300 above the blanket system 100, and a substrate transport system 500 below the blanket system 100. While circulating in a loop, the blanket passes through various stations including a drying station and at least one impression station. Though the below description is provided in the context of the intermediate transfer member being an endless flexible belt, the present invention is equally applicable to printing systems wherein the intermediate transfer member is a drum, the specific designs of the various stations being accordingly adapted.

The blanket system 100 includes an endless belt or blanket 102 that acts as an intermediate transfer member (ITM) and is guided over two or more rollers. Such rollers are illustrated in FIG. 1 as elements 104 and 106, whereas FIG. 2 displays two additional such blanket conveying rollers as 108 and 110. One or more guiding roller is connected to a motor, such that the rotation of the roller is able to displace the blanket in the desired direction, and such cylinder may be referred to as a driving roller. As used herein, the term "printing direction" means a direction from the image forming station where printing heads apply ink to the release layer towards the location of the impression station, where the ink image is ultimately transferred to the printing substrate. In FIGS. 1 and 2, the printing direction is illustrated as clockwise.

Though not illustrated in the Figures, the blanket can have multiple layers to impart desired properties to the transfer member. Thus in addition to an outer layer receiving the ink image and having suitable release properties, hence also called the release layer, the transfer member may include in its underlying body any one of a reinforcement layer (e.g., a fabric) to provide desired mechanical characteristics (e.g., resistance to stretching), a compressible layer so that the blanket or the drum surface can conform to the printing substrate during transfer, a conformational layer to provide to the surface of the release layer sufficient conformability toward the topography of a substrate surface, and various other layers to achieve any desired friction, thermal and electrical properties or adhesion/connection between any such layers. When the body of the transfer member comprises a compressible layer, the blanket can be looped to form what can be referred to hereinafter as a "thick belt". Alternatively, when the body is substantially devoid of a compressible layer, the resulting structure is said to form a "thin belt". FIG. 1 illustrates a printing system suitable for use with a "thick belt", whereas FIG. 2 illustrates a printing system suitable for a "thin belt".

Independently of exact architecture of the printing system, an image made up of droplets of an aqueous ink is applied by image forming system 300 to an upper run of blanket 102 at a location referred herein as the image forming station. In this context, the term "run" is used to mean a length or segment of the blanket between any two given rollers over which the blanket is guided. The image forming system 300 includes print bars 302 which may each be slidably mounted on a frame positioned at a fixed height above the surface of the blanket 102 and include a strip of print heads with individually controllable print nozzles through which the ink is ejected to form the desired pattern. The image forming system can have any number of bars 302, each of which may contain an ink of a different or of the same color, typically each jetting Cyan (C), Magenta (M), Yellow (Y) or Black (K) inks. It is possible for the print bars to deposit different shades of the same color (e.g., various shades of gray, including black) or customized mix of colors (e.g., brand colors) or for two print bars or more to deposit the same color (e.g., black). Additionally, the print bar can be used for pigmentless liquids (e.g., decorative or protective varnishes) and/or for specialty inks (e.g., achieving visual effect, such as metallic, sparkling, glowing or glittering look, or even scented effect).

Within each print bar, the ink may be constantly recirculated, filtered, degassed and maintained at a desired temperature and pressure, as known to the person skilled in the art without the need for more detailed description. As different print bars 302 are spaced from one another along the length of the blanket, it is of course essential for their operation to be correctly synchronized with the movement of blanket 102. It is important for the blanket 102 to move with constant speed through the image forming station 300, as any hesitation or vibration will affect the registration of the ink droplets of different colors.

If desired, it is possible to provide a blower 304 following each print bar 302 to blow a slow stream of a hot gas, preferably air, over the intermediate transfer member to commence the drying of the ink droplets deposited by the print bar 302. This assists in fixing the droplets deposited by each print bar 302, that is to say resisting their contraction and preventing their movement on the intermediate transfer member, and also in preventing them from merging into droplets deposited subsequently by other print bars 302. Such post jetting treatment of the just deposited ink droplets, need not substantially dry them, but only enable the formation of a skin on their outer surface.

Figure 2:
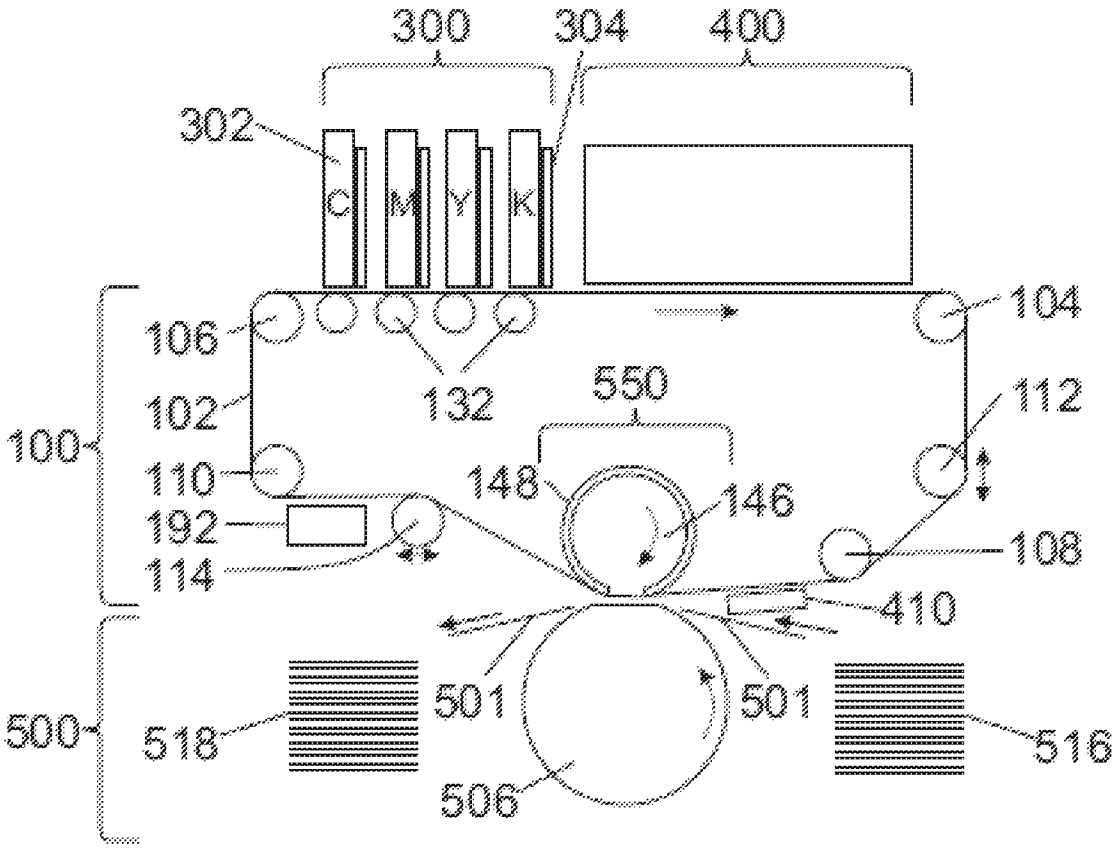
FIG. 2 is a schematic representation of an alternative printing system in accordance with which an embodiment of the invention may be used.

The image forming station illustrated in FIG. 2 comprises optional rollers 132 to assist in guiding the blanket smoothly adjacent each printing bar 302. The rollers 132 need not be precisely aligned with their respective print bars and may be located slightly (e.g., few millimeters) downstream or upstream of the print head jetting location. The frictional forces can maintain the belt taut and substantially parallel to the print bars. The underside of the blanket may therefore have high frictional properties as it is only ever in rolling contact with all the surfaces on which it is guided.

Following deposition of the desired ink image by the image forming system 300 on an upper run of the transfer member, the image is dried by a drying system 400 described below in more details. A lower run of the blanket then selectively interacts at an impression station where the transfer member can be compressed to an impression cylinder to impress the dried image from the blanket onto a printing substrate. FIG. 1 shows two impression stations with two impression cylinders 502 and 504 of the substrate transport system 500 and two respectively aligned pressure or nip rollers 142, 144, which can be raised and lowered from the lower run of the blanket. When an impression cylinder and its corresponding pressure roller are both engaged with the blanket passing there-between, they form an impression station 550. The presence of two impression stations, as shown in FIG. 1, is to permit duplex printing. In this figure, the perfecting of the substrate is implemented by a perfecting cylinder 524 situated in between two transport rollers 522 and 526 which respectively transfer the substrate from the first impression cylinder 502 to the perfecting cylinder 524 and therefrom on its reverse side to the second impression cylinder 504. Though not illustrated, duplex printing can also be achieved with a single impression station using an adapted perfecting system able to refeed to the impression station on the reverse side a substrate already printed on its first side. In the case of a simplex printer, only one impression station would be needed and a perfecting system would be superfluous. Perfecting systems are known in the art of printing and need not be detailed.

FIG. 2 illustrates an alternative printing system suitable for a "thin belt" looped blanket which is compressed during engagement with the impression cylinder 506 by a pressure roller 146 which to achieve intimate contact between the release layer of the ITM and the substrate comprises the compressible layer substantially absent from the body of the transfer member. The compressible layer of the pressure roller 146 typically has the form of a replaceable compressible blanket 148. Such compressible layer or blanket is releasably clamped or attached onto the outer surface of the pressure cylinder 146 and provides the conformability required to urge the release layer of the blanket 102 into contact with the substrate sheets 501. Rollers 108 and 114 on each side of the impression station, or any other two rollers spanning this station closer to the nip (not shown), ensure that the belt is maintained in a desired orientation as it passes through the nip between the cylinders 146 and 506 of the impression station 550.

In this system, both the impression cylinder 506 and the pressure roller 146 bearing a compressible layer or blanket 148 can have as cross section in the plane of rotation a partly truncated circular shape. In the case of the pressure roller, there is a discontinuity where the ends of the compressible layer are secured to the cylinder on which it is supported. In the case of the impression cylinder, there can also be a discontinuity to accommodate grippers serving to hold the sheets of substrate in position against the impression cylinder. The impression cylinder and pressure roller of impression station 550 rotate in synchronism so that the two discontinuities line up during cycles forming periodically an enlarged gap at which time the blanket can be totally disengaged from any of these cylinders and thus be displaced in suitable directions to achieve any desired alignment or at suitable speed that would locally differ from the speed of the blanket at the image forming station. This can be achieved by providing powered tensioning rollers or dancers 112 and 114 on opposite sides of the nip between the pressure and impression cylinders. Although roller 114 is illustrated in FIG. 2 as being in contact with the inner/underneath side of the blanket, alignment can similarly be achieved if it were positioned facing the release layer. This alternative, as well as additional optional rollers positioned to assist the dancers in their function, are not shown. The speed differential will result in slack building up on one side or the other of the nip between the pressure and impression cylinders and the dancers can act at times when there is an enlarged gap between the pressure and impression cylinders 146 and 506 to advance or retard the phase of the belt, by reducing the slack on one side of the nip and increasing it on the other.

Independently of the number of impression stations, their configuration, the layer structure of the transfer member and the presence or absence of a perfecting mechanism in such printing systems, in operation, ink images, each of which is a mirror image of an image to be impressed on a final substrate, are printed by the image forming system 300 onto an upper run of blanket 102. While being transported by the blanket 102, the ink is heated to dry it by evaporation of most, if not all, of the liquid carrier. The carrier evaporation may start at the image forming station 300 and be pursued and/or completed at a drying station 400 able to substantially dry the ink droplets to form a residue film of ink solids remaining after evaporation of the liquid carrier. The residue film image is considered substantially dry or the image dried if any residual carrier they may contain does not hamper transfer to the printing substrate and does not wet the printing substrate. The dried ink image can be further heated to render tacky the film of ink solids before being transferred to the substrate at an impression station. Such optional pre-transfer heater 410 is shown in FIG. 2.

Figure 1:
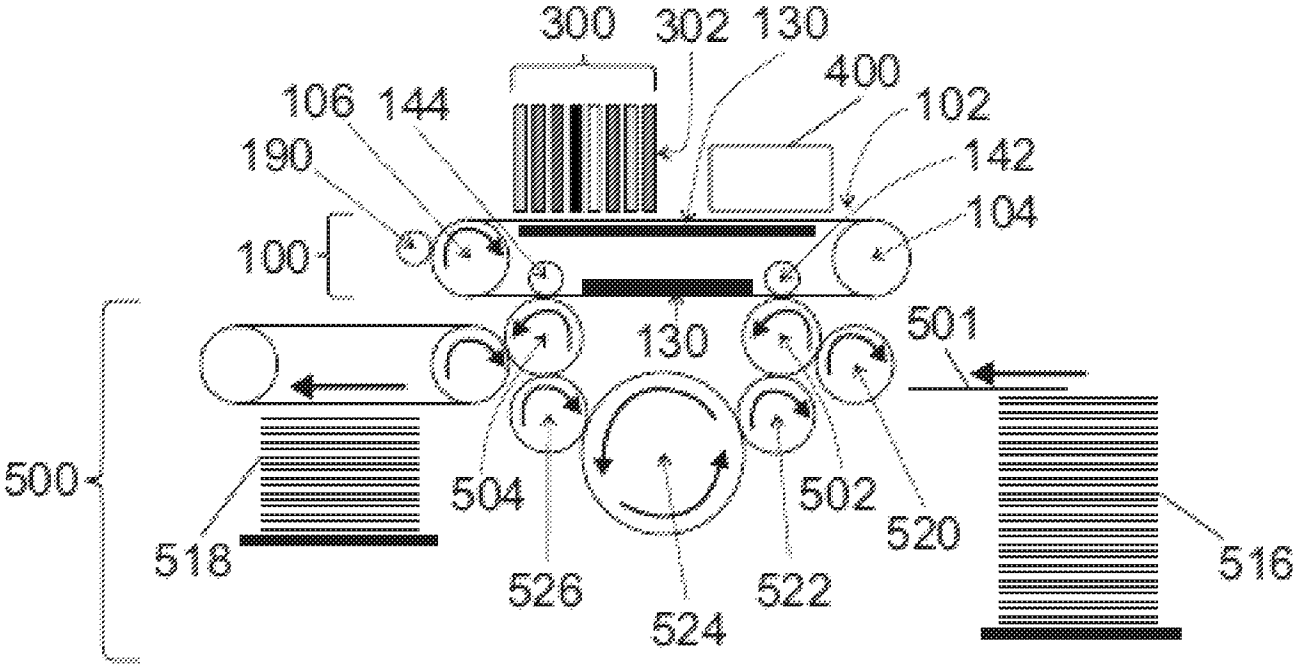
FIG. 1 is a schematic representation of a printing system in accordance with which an embodiment of the invention may be used.

FIGS. 1 and 2 depict the image being impressed onto individual sheets 501 of a substrate which are conveyed by the substrate transport system 500 from an input stack 516 to an output stack 518 via the impression cylinders 502, 504 or 506. Though not shown in the figures, the substrate may be a continuous web, in which case the input and output stacks are replaced by a supply roller and a delivery roller. The substrate transport system needs to be adapted accordingly, for instance by using guide rollers and dancers taking slacks of web to properly align it with the impression station.

The Drying System

Printing systems wherein the present invention may be practiced can comprise a drying system 400. As noted any drying system able to evaporate the ink carrier out of the ink image deposited at the image forming station 300 to substantially dry it by the time the image enters the impression station is suitable. Such system can be formed from one or more individual drying elements typically disposed above the blanket along its path. The drying element can be radiant heaters (e.g., IR or UV) or convection heaters (e.g., air blowers) or any other mean known to the person of skill in the art. The settings of such a system can be adjusted according to parameters known to professional printers, such factors including for instance the type of the inks and of the transfer member, the ink coverage, the length/area of the transfer member being subject to the drying, the printing speed, the presence/effect of a pre-transfer heater etc.

Operating Temperatures

Each station of such printing systems may be operated at same or different temperatures. The operating temperatures are typically selected to provide the optimal temperature suitable to achieve the purported goal of the specific station, preferably without negatively affecting the process at other steps. Therefore as well as providing heating means along the path of the blanket, it is possible to provide means for cooling it, for example by blowing cold air or applying a cooling liquid onto its surface. In printing systems in which a treatment or conditioning fluid is applied to the surface of the blanket, the treatment station may serve as a cooling station.

The temperature at various stage of the process may also vary depending on the exact composition of the intermediate transfer member, the inks and the conditioning fluid, if needed, being used and may even fluctuate at various locations along a given station. In some embodiments of the invention, the temperature on the outer surface of the transfer member at the image forming station is in a range between 40° C. and 160° C., or between 60° C. and 90° C. In some embodiments of the invention, the temperature at the drying station is in a range between 90° C. and 300° C., or between 150° C. and 250° C., or between 180° C. and 225° C. In some embodiments, the temperature at the impression station is in a range between 80° C. and 220° C., or between 100° C. and 160° C., or of about 120° C., or of about 150° C. If a cooling station is desired to allow the transfer member to enter the image forming station at a temperature that would be compatible to the operative range of such station, the cooling temperature may be in a range between 40° C. and 90° C.

As mentioned, the temperature of the transfer member may be raised by heating means positioned externally to the blanket support system, as illustrated by any of heaters 304, 400 and 410, when present in the printing system. Alternatively and additionally, the transfer member may be heated from within the support system. Such an option is illustrated by heating plates 130 of FIG. 1. Though not shown, any of the guiding rollers conveying the looped blanket may also comprise internal heating elements.

Blanket and Blanket Support System

The intermediate transfer member can be a belt formed of an initially flat elongate blanket strip of which the ends can be releasably fastened or permanently secured to one another to form a continuous loop. A releasable fastening for blanket 102 may be a zip fastener or a hook and loop fastener that lies substantially parallel to the axes of rollers 104 and 106 over which the blanket is guided. A zip fastener, for instance, allow easy installation and replacement of the belt. A permanent securing may be achieved by soldering, welding, adhering, and taping the ends of the blanket to one another (e.g., using Kapton® tape, RTV liquid adhesives or PTFE thermoplastic adhesives with a connective strip overlapping both edges of the strip). Independently of the mean elected to releasably or permanently secure these ends to form a continuous flexible belt, the secured ends, which cause a discontinuity in the transfer member, are said to form a seam. The continuous belt may be formed by more than one elongated blanket strip and may therefore include more than one seam.

In order to avoid a sudden change in the tension of the belt as the seam passes over rollers or other parts of the support system, it is desirable to make the seam, as nearly as possible, of the same thickness as the remainder of the blanket. It is desirable to avoid an increase in the thickness or discontinuity of chemical and/or mechanical properties of the belt at the seam. Preferably, no ink image or part thereof is deposited on the seam, but only as close as feasible to such discontinuity on an area of the belt having substantially uniform properties/characteristics. Alternatively, the belt may be seamless.

Blanket Lateral Guidance

In some instances, the blanket support system further includes a continuous track that can engage formations on the side edges of the blanket to maintain the blanket taut in its width ways direction. The formations may be spaced projections, such as the teeth of one half of a zip fastener sewn or otherwise attached to each side edge of the blanket. Such lateral formations need not be regularly spaced. Alternatively, the formations may be a continuous flexible bead of greater thickness than the blanket. The lateral formations may be directly attached to the edges of the blanket or through an intermediate strip that can optionally provide suitable elasticity to engage the formations in their respective guiding track, while maintaining the blanket flat in particular at the image forming station. The lateral track guide channel may have any cross-section suitable to receive and retain the blanket lateral formations and maintain it taut. To reduce friction, the guide channel may have rolling bearing elements to retain the projections or the beads within the channel.

The lateral formations may be made of any material able to sustain the operating conditions of the printing system, including the rapid motion of the blanket. Suitable materials can resist elevated temperatures in the range of about 50° C. to 250° C. Advantageously, such materials are also friction resistant and do not yield debris of size and/or amount that would negatively affect the movement of the belt during its operative lifespan. For example, the lateral projections can be made of polyamide reinforced with molybdenum disulfide.

As the lateral guide channels ensure accurate placement of the ink droplets on the blanket, their presence is particularly advantageous at the image forming station 300. In other areas, such as within the drying station 400 and an impression station 550, lateral guide channels may be desirable but less important. In regions where the blanket has slack, no guide channels are present. Further details on exemplary blanket lateral formations or seams that may be suitable for intermediate transfer members according to the present invention are disclosed in PCT Publication No. WO 2013/136220.

Such lateral formations and corresponding guide channels are typically not necessary when the intermediate transfer member is mounted on a rigid support.

The ends of the blanket strip are advantageously shaped to facilitate guiding of the belt through the lateral channels and over the rollers during installation. Initial guiding of the belt into position may be done for instance by securing the leading edge of the belt strip introduced first in between the lateral channels to a cable which can be manually or automatically moved to install the belt. For example, one or both lateral ends of the belt leading edge can be releasably attached to a cable residing within each channel. Advancing the cable(s) advances the belt along the channel path. Alternatively or additionally, the edge of the belt in the area ultimately forming the seam when both edges are secured one to the other can have lower flexibility than in the areas other than the seam. This local "rigidity" may ease the insertion of the lateral formations of the belt strip into their respective channels.

The blanket support system may comprise various additional optional subsystems, such as a Cleaning Station, a Cooling Station and a Conditioning Station, the latter to be detailed separately in the following section.

Blanket Cleaning Station

Though not shown in the figures, the blanket system may further comprise a cleaning station which may be used to gently remove any residual ink images or any other trace particle from the release layer. Such cleaning step may for instance be applied in between printing jobs to periodically "refresh" the belt. The cleaning station may comprise one or more devices each individually configured to remove same or different types of undesired residues from the surface of the release layer. In one embodiment, the cleaning station may comprise a device configured to apply a cleaning fluid to the surface of the transfer member, for example a roller having cleaning liquid on its circumference, which preferably should be replaceable (e.g., a pad or piece of paper). Residual particles may optionally be further removed by an absorbent roller or by one or more scraper blades.

The Control Systems

The above descriptions are simplified and provided only for the purpose of enabling an understanding of exemplary printing systems and processes with which the presently claimed invention may be used. In order for the image to be properly formed on the blanket and transferred to the final substrate and for the alignment of the front and back images in duplex printing to be achieved, a number of different elements of the system must be properly synchronized. In order to position the images on the blanket properly, the position and speed of the blanket must be both known and controlled. For this purpose, the blanket can be marked at or near its edge with one or more markings spaced in the direction of motion of the blanket. One or more sensors can be located in the printing system along the path of the blanket to sense the timing of these markings as they pass the sensor. Signals from the sensor(s) can be sent to a controller which may also receive an indication of the speed of rotation and angular position of any of the rollers conveying the blanket, for example from encoders on the axis of one or both of the impression rollers. The sensor(s) may also determine the time at which the seam of the blanket passes the sensor. For maximum utility of the usable length of the blanket, it is desirable that the images on the blanket start as close to the seam as feasible. For a successful printing system, the control of the various stations of the printing system is important but need not be considered in detail in the present context. Exemplary control systems that may be suitable for printing systems in which the present invention can be practiced are disclosed in PCT Publication No. WO 2013/132424.

Blanket Conditioning Station

In some printing systems, the intermediate transfer member can be treated to further increase the interaction of the compatible ink with the ITM, or further facilitate the release of the dried ink image to the substrate, or provide for a desired printing effect. The treating station may apply a physical treatment or a chemical treatment. In the present case the ITM is treated with a chemical conditioning agent, such as an emulsion of a positively charged polymer according to the teachings herein. The compositions being applied to the intermediate transfer member are often referred to as treatment solutions or conditioning fluids and the station at which such treatment may take place is referred to as a conditioning station. This station is typically located upstream the image forming station and the treatment is applied before an ink image is jetted.

Such a station is schematically illustrated in FIG. 1 as roller 190 positioned on the external side of the blanket adjacent to roller 106 and in FIG. 2 as applicator 192. Such a roller 190 or applicator 192 may be used to apply a thin even film of treatment solution containing a conditioning chemical agent. The conditioning fluid can alternatively be sprayed onto the surface of the blanket and optionally spread more evenly, for example by the application of a jet from an air knife. Alternatively, the conditioning solution may be applied by passing the blanket over a thin film of conditioning solution seeping through a cloth having no direct contact with the surface of the release layer. Surplus of treatment solution, if any, can be removed by air knife, scrapper, squeegee rollers or any suitable manner. As the film of conditioning solution being applied is typically very thin, its vehicle is totally removed from the film by the time it reaches the print bars of the image forming system and the blanket surface is substantially dry upon entry through the image forming station. Preferably, the very thin dried layer of chemical agent on the surface of the blanket assists the ink droplets to retain their film-like shape after they have impacted the surface of the blanket.

The conditioning solution is applied with every cycle of the belt. Alternatively, it may be applied periodically at intervals of suitable number of cycles.

The purpose of the applied chemical agent is to counteract the effect of the surface tension of the aqueous ink upon contact with the hydrophobic release layer of the blanket, without necessarily reducing said surface tension. Without wishing to be bound by theory, it is believed that such pre-treatment chemical agents, for instance some positively charged polymers, will adhere (temporarily at least), to the silicone surface of the transfer member to form a positively charged layer. However, the amount of charge that is present in such a layer is believed to be much smaller than the negative charge in the droplet itself. The present inventors have found that a very thin layer of chemical agent, perhaps even a layer of molecular thickness, is adequate. This layer of pre-treatment chemical agent on the transfer member may be applied in very dilute form of the suitable chemical agents. Ultimately this thin layer may be transferred onto the substrate, along with the image being impressed.

When the ink droplet impinges on the transfer member, the momentum in the droplet causes it to spread into a relatively flat volume. In the prior art, this flattening of the droplet is almost immediately counteracted by the combination of surface tension of the droplet and the hydrophobic nature of the surface of the transfer member.

In embodiments of the invention, the shape of the ink droplet is "frozen" such that at least some and preferably a major part of the flattening and horizontal extension of the droplet present on impact is preserved. It should be understood that since the recovery of the droplet shape after impact is very fast, the methods of the prior art would not effect phase change by agglomeration and/or coagulation and/or migration.

Without wishing to be bound by theory, it is believed that, on impact, the positive charges which have been placed on the transfer member attract the negatively charged polymer resin particles of the ink droplet that are immediately adjacent to the surface of the member. It is believed that, as the droplet spreads, this effect takes place along a sufficient area of the interface between the spread droplet and the transfer member to retard or prevent the beading of the droplet, at least on the time scale of the printing process, which is generally on the order of seconds.

As the amount of charge is too small to attract more than a small number of charged resin particles in the ink, it is believed that the concentration and distribution of the charged resin particles in the drop is not substantially changed as a result of contact with the chemical agent on the release layer. Furthermore, since the ink is aqueous, the effects of the positive charge are very local, especially in the very short time span needed for freezing the shape of the droplets.

While the applicants have found that coating the intermediate transfer member with a polymer utilizing a roller or an application cloth is an effective method for freezing the droplets, it is believed that spraying or otherwise chemically transferring positive charge to the intermediate transfer member is also possible.

Ink

Inks that are suitable for use in conjunction with the treated are release layer are, for example, aqueous inkjet inks that contain (i) a solvent comprising water and optionally a co-solvent, (ii) a negatively chargeable polymeric resin (the ink may include a small amount of a pH-raising substance to ensure that the polymer is negatively charged), and (iii) at least one colorant. In some embodiments, one or more of the following is also true of the inks: water constitutes at least 8 wt. % of the ink; the at least one colorant is dispersed or at least partly dissolved within the solvent and constitutes at least 1 wt. % of the ink; the polymeric resin is dispersed or at least partially dissolved within the solvent and constitutes 6 to 40 wt. % of the ink; the average molecular weight of the polymeric resin is least 8,000; and prior to jetting the ink has at least one of (i) a viscosity of 2 to 25 centipoise at at least one temperature in the range of 20-60° C. and (ii) a surface tension of not more than 50 milliNewton/m at at least one temperature in the range of 20-60° C. In some embodiments, the ink is such that, when substantially dried, (a) at at least one temperature in the range of 90° C. to 195° C., the dried ink has a first dynamic viscosity in the range of 1,000,000 ($1\times10^6$) cP to 300,000,000 ($3\times10^8$) cP, and (b) at at least one temperature in the range of 50° C. to 85° C., the dried ink has a second dynamic viscosity of at least 80,000,000 ($8\times10^7$) cP, wherein the second dynamic viscosity exceeds the first dynamic viscosity; and/or the weight ratio of the resin to the colorant is at least 1:1. In some embodiments, the ink is such that, when substantially dried, the dried ink has: (i) a first dynamic viscosity within a range of $10^6$ cP to $5\cdot10^7$ cP at at least a first temperature within a first 15 range of 60° C. to 87.5° C.; and (ii) a second dynamic viscosity of at least $6\cdot10^7$ cP, for at least a second temperature within a second range of 50° C. to 55° C. The colorant may contain a pigment, preferably a nanopigment, for example having an average particle size ($D_{50}$) of not more than 120 nm. With respect to the ink, "substantially dried" refers to ink that has no more solvent and other volatile compounds than does a layer of the ink of 1 mm initial thickness after such a layer is dried in an oven for 12 hours at 100° C.

Ink Image Heating

The heaters, either inserted into the support plates 130 or positioned above the blanket as intermediate drying system 224 and drying station 214, are used to heat the blanket to a temperature that is appropriate for the rapid evaporation of the ink carrier and compatible with the composition of the blanket. For blankets comprising for instance silanol-, modified or terminated polydialkylsiloxane silicones in the release layer, heating may vary within a range from 50° C. to 220° C., depending on various factors such as the composition of the inks and/or of the conditioning liquid(s) if needed. The blanket temperature may be substantially the same from ink deposition to transfer (e.g., of the order of 150° C.) or may vary between the various stations of the printing system. When using beneath heating of the transfer member, it is desirable for the blanket to have relatively high thermal capacity and low thermal conductivity, so that the temperature of the body of the blanket 102 will not change significantly as it moves between the pre-treatment or conditioning station, the image forming station and the impression station(s). When using top heating of the transfer member, the blanket would preferably include a thermally insulating layer to prevent undue dissipation of the applied heat. To apply heat at different rates to the ink image carried by the transfer surface, independently of the architecture of a particular printing system, additional external heaters or energy sources (not shown) may be used to apply energy locally, for example prior to reaching the impression stations to render the ink residue tacky (see 231 in FIG. 3), prior to the image forming station to dry the conditioning agent if necessary and at the printing station to start evaporating the carrier from the ink droplets as soon as possible after they impact the surface of the blanket.

The external heaters may be, for example, hot gas or air blowers 306 (as represented schematically in FIG. 1) or radiant heaters focusing, for example, infrared radiation onto the surface of the blanket, which may attain temperatures in excess of 175° C., 190° C., 200° C., 210° C., or even 220° C.

The residue film left behind in embodiments of the invention may have an average thickness below 1500 nm, below 1200 nm, below 1000 nm, below 800 nm, below 600 nm, below 500 nm, below 400 nm, or below 300 nm.

As explained above, temperature control is of paramount importance to the printing system if printed images of high quality are to be achieved. This is considerably simplified in the embodiment of FIG. 3 in that the thermal capacity of the belt is much lower than that of the blanket 102 in the embodiments of FIGS. 1 and 2.

It has also been proposed above in relation to the embodiment using a thick blanket 102 to include additional layers affecting the thermal capacity of the blanket in view of the blanket being heated from beneath. The separation of the belt 210 from the blanket 219 in the embodiment of FIG. 3 allows the temperature of the ink droplets to be dried and heated to the softening temperature of the resin using much less energy in the drying section 214. Furthermore, the belt may cool down before it returns to the image forming station which reduces or avoids problems caused by trying to spray ink droplets on a hot surface running very close to the inkjet nozzles. Alternatively and additionally, a cooling station may be added to the printing system to reduce the temperature of the belt to a desired value before the belt enters the image forming station. Cooling may be effected by passing the belt 210 over a roller of which the lower half is immersed in a coolant, which may be water or a cleaning/treatment solution, by spraying a coolant onto the belt of by passing the belt 210 over a coolant fountain.

In some of the arrangements discussed hitherto, the release layer of the belt 210 has hydrophobic properties to ensure that the tacky ink residue image peels away from it cleanly in the transfer station. However, at the image forming station the same hydrophobic properties are undesirable because aqueous ink droplets can move around on a hydrophobic surface and, instead of flattening on impact to form droplets having a diameter that increases with the mass of ink in each droplet, the ink tends to ball up into spherical globules. As discussed, in structures using a hydrophobic release layer, steps therefore need to be taken to encourage the ink droplets, which flatten out into a disc on impact, to retain their flattened shape during the drying and transfer stages.

Printing systems as described herein may be produced by modification to existing lithographic printing presses. The ability to adapt existing equipment, while retaining much of the hardware already present, considerably reduces the investment required to convert from technology in common current use. In particular, in the case of the embodiment of FIG. 1, the modification of a tower would involve replacement of the plate cylinder by a set of print bars and replacement of the blanket cylinder by an image transfer drum having a hydrophobic outer surface or carrying a suitable blanket. In the case of the embodiment of FIG. 3, the plate cylinder would be replaced by a set of print bars and a belt passing between the existing plate and blanket cylinders. The substrate handling system would require little modification, if any. Color printing presses are usually formed of several towers and it is possible to convert all or only some of the towers to digital printing towers. Various configurations are possible offering different advantages. For example each of two consecutive towers may be configured as a multicolor digital printer to allow duplex printing if a perfecting cylinder is disposed between them. Alternatively, multiple print bars of the same color may be provided on one tower to allow an increased speed of the entire press.

The following examples illustrate embodiments of the invention.

Example 1

An inkjet ink formulation was prepared containing:

| Ingredient | Function | wt. % |
|---|---|---|
| Carbon Black, Monarch ® 700 (Cabot) | Pigment | 1.5 |
| Joncryl ® 2038, 43.5% emulsion in water | Resin | 13.8 (6% solids) |
| Tween ® 40 | Softening agent | 3.0 |
| Capstone FS-65 (DuPont) | Non-ionic fluorosurfactant | 0.01 |
| Water | — | Balance to 100% |
| Joncryl HPD 296 (35.5% water solution) (BASF) | Dispersant | 4.2 (solid resin) |
| Ethylene glycol (Aldrich) | Water-miscible co-solvent | 15 |

Preparation procedure: A pigment concentrate, containing pigment (14%), water (79%) and Joncryl® HPD 296 (7%) were mixed and milled using a homemade milling machine. The progress of milling was controlled by particle size measurement (Malvern, Nanosizer). The milling stopped when the particle size ($D_{50}$) reached 70 nm. Then the rest of the materials were added to the pigment concentrate. After mixing the ink was filtered through 0.5 micrometer filter.

The efficacy of various materials in improving the transfer of the black ink formulation described above were tested as follows:

Emulsions containing 1, 2 and 3 wt. % of GP-4 (amine functional silicone of formula I, with the blocks randomly distributed, x=58, y=4, R=$C_3H_6$, amine number=90, MW ~4922) in water were prepared by mixing an appropriate amount of GP-4 in an appropriate amount of distilled water at room temperature for five minutes at 3000 rpm in an IKA high shear mixer. These were respectively referred to as SOL1, SOL2 and SOL3. A fourth emulsion, called SOL4, was prepared from 100 parts distilled water, two parts GP-965 (amine functional silicone of formula II, R=R'=$C_3H_6$, x=10, amine number=200, MW ~1000) and 0.04 parts Triton X-100 (non-ionic surfactant) by ultrasonic mixing (Vibra mixer from Sonics, 20 kHz, 750 W). For the sake of comparison, an aqueous solution containing 0.3 wt. % polyethylene imine (Lupasol® PS, charge density 20 meq/g, MW 750,000, hereinafter referred to as the PEI solution; see PCT publication No. WO 2013/132339 for more details) was prepared.

Formula (IV)

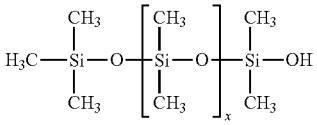

A silanol-terminated polydimethyl siloxane silicone (PDMS) release layer was prepared by condensation curing of the following ingredients: Gelest DMS-S27 (silanol terminated polydimethylsiloxane of formula IV above, having an average MW of 18,000 and about 0.2% OH), 100 parts, Colcoat Ethyl silicate 48, 9 parts Tib Kat 223 (Dioctyltin dineodecanoate catalyst), 0.5 parts, as described in PCT publication No. WO 2013/132432, which is incorporated herein by reference. The release layer was applied in dust-free, environmentally controlled conditions of temperature at 20-25° C. and relative humidity between 40% and 70% to a standard blanket body that provides an underlying mechanical support. The thickness of the condensation cured release layer (CCRL) was approximately 40-80 μm. A piece of this printing blanket of approximately 200 mm×300 mm area having the release layer on its outer surface was fixed on a hotplate and heated to 70-80° C. SOL1 (comprising about 1 wt. % GP-4) and the PEI solution were applied to separate halves of the release layer to a thickness of approximately 1 micrometer to completely cover the image transfer surface of the release layer. Specifically, the solution was sprayed at the image transfer surface of the release layer and then evened to the desired thickness using a wipe. After about 30 seconds, the water of the pretreatment solution evaporated, leaving a sub-micron thin layer of PEI or aminosilicone fluid as a chemical agent coating the image transfer surface of the release layer. A thin film of the black ink described above was spread on the treated release layer using a smooth rod. The ink did not show any beading on the release layer surface. After about 30 s the ink was dried on the release layer and a piece of Condat 135 gsm coated paper was pressed against the inked release layer. The process was repeated using uncoated paper (Xerox Business ECF/003R91820 Photocopier Paper DIN A4 80 gsm). In all four cases (amine functionalized silicone and PEI, coated and uncoated paper) the ink was completely transferred to the paper, giving a continuous shiny film on the paper.

This method of assessing the suitability of a conditioning agent to satisfactorily treat the surface of a release layer such that ink applied thereafter is fully transferred therefrom is also termed the drawdown screening method. It was used for preliminary selection of conditioning agents tested first in undiluted form ("neat", namely at 100% concentration) as provided by their respective suppliers. The agents that promoted full transfer of a continuous ink film to coated and uncoated papers included GP-4, GP-6, GP-316, GP-345, GP-965 (from Genesee), KF-861, KF-864, KF-869 (from Shin Etsu), Silamine® A0-EDA, and Silamine® D2-EDA (from Siltech). The amine number of these materials, as provided by supplier or determined experimentally, was respectively 90, 50, 54, 7, and 200, for the polymers of the GP series; 127, 27-30, and 54 for the polymers of the KF series; and 230 and 250 for the polymers of the Silamine® series.

Other candidates yielded only partly satisfactory results (e.g., partially prevented beading on the tested release layer, but enabled full transfer of the resulting discontinuous dry ink film). Such compounds, like Rhodorsil® H21 645 of Bluestar Silicones, may be less suitable because of the nature of their amine group which being hindered might be "underexposed" within the molecule thus less able to interact either with the release layer or the ink or both. Alternatively, or additionally such compounds might be less suitable in view of their low nitrogen content (e.g., 0.25% N in Rhodorsil® H21 645), as its Amine Number of 18 favorably compare to GP-345.

Example 2

Example 1 was repeated, but this time the surface of the CCRL PDMS release layer, instead of being spread with a thin film of ink, was printed with drops of ink of 9 picoliter drop size, using a Fujifilm Dimatix DMP-2800 printer (www.fujifilmusa.com/products/industrial_inkjet_printheads/deposition-products/dmp-2800/index.html). Again, beading of the ink on the treated release layer surface was not observed, and results similar to those in Example 1 were obtained for both the PEI and amine functionalized silicone (SOL1 comprising about 1 wt. % of GP-4) treatments, for both coated and uncoated paper as above-identified.

Example 3

Example 1 was repeated, but this time SOL4 (comprising about 2 wt. % GP-965) was used to treat the CCRL PDMS release layer instead of SOL1. A continuous shiny film was obtained on the coated paper for both the PEI and amine functionalized silicone treatments. Beading of the ink on the treated release layer surface was not observed. Printing on the uncoated paper showed that transfer from the PEI-coated portion of the release layer was not complete, but transfer from the GP-965-coated portion was complete.

Example 4

Example 1 was repeated, except that instead of SOL1, the CCR PDMS release layer was coated with SOL5 (100 parts distilled water, 4 parts GP-4, 0.02 parts Triton X-100, sonicated as in the preparation of SOL4), and the Fujifilm Dimatix printer was used to jet 9 pL drops of the ink. Beading of the ink on the treated release layer surface was not observed. The dried ink film was transferred to both coated and uncoated paper as described in Example 1. Print quality following treatment with SOL5 (comprising about 4 wt. % of GP-4) was compared to PEI by optical density and dot size measurements. Such evaluations were generally made on at least three representative areas of a typical print-out or on representative areas of at least three print-outs. Optical density (OD) was measured using a Spectrodensitometer (500 Series from X-rite) at the desired ink coverage, a higher OD indicating a better transfer. The average diameters of the printed dots was measured by microscopy using optical & laser microscopes (LEXT from Olympus) at ×20 magnification. Generally isolated dots were selected from areas with ink coverage of 10% or less.

Figure 3A:
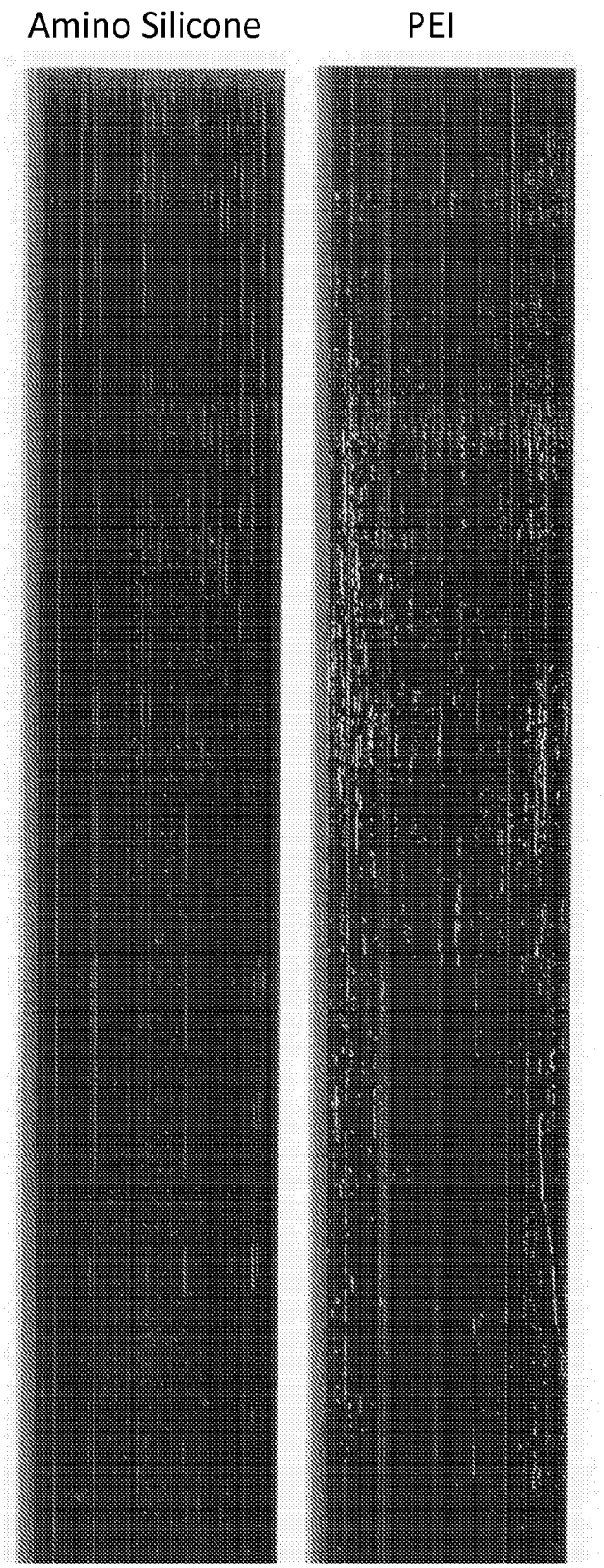
FIG. 3A shows a print-out of an ink image transferred from an intermediate transfer member treated according an embodiment of the invention, the release layer being prepared by condensation curing.
Figure 3B:
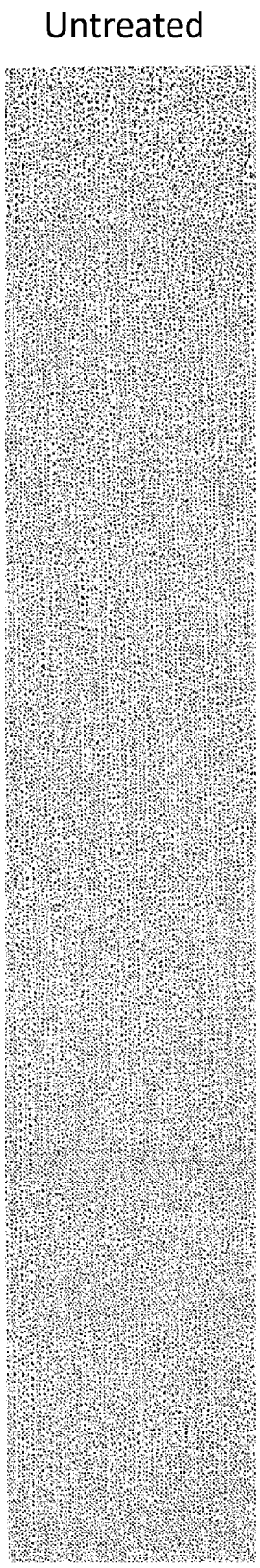
FIG. 3B shows a print-out of an ink image transferred from an intermediate transfer member having a release layer prepared by condensation curing, the layer not being treated prior to ink jetting.
Figure 4:
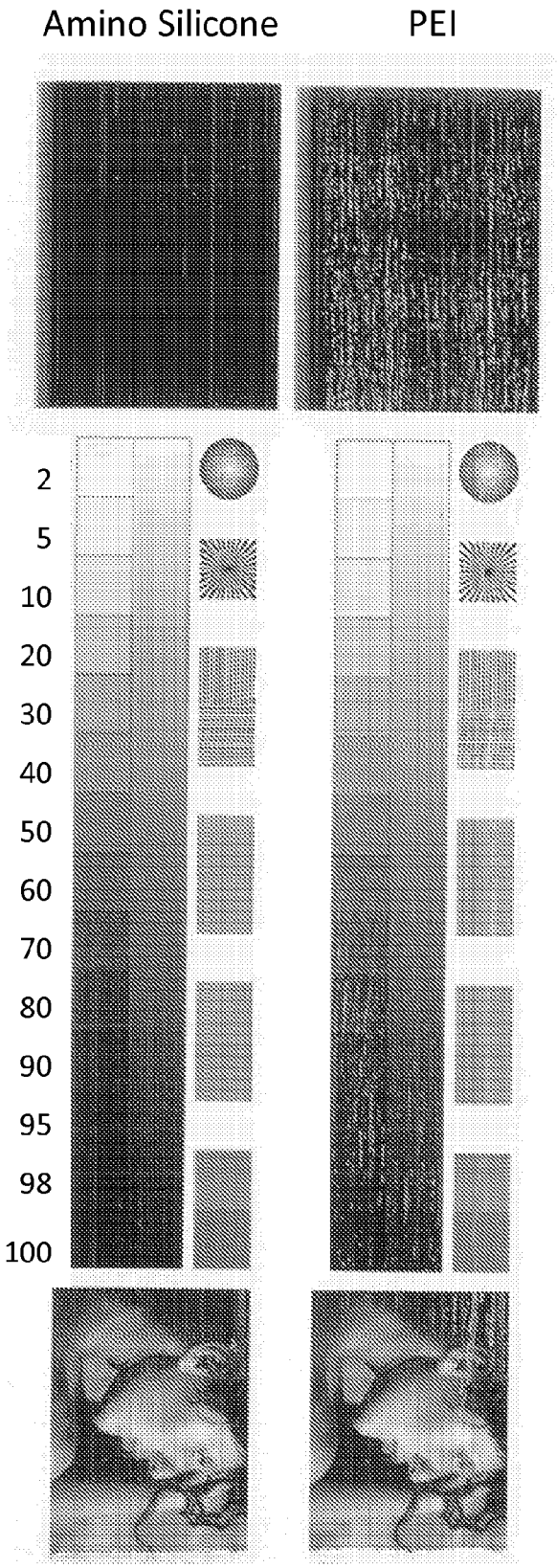
FIG. 4 shows a print-out of an ink image transferred from an intermediate transfer member treated according to an embodiment of the invention, the release layer being prepared by condensation curing and the transfer being to coated paper.

FIG. 3A shows a typical print-out of a 100% ink coverage test file on coated paper. For comparison, FIG. 3B displays an illustrative print that may be obtained under the same conditions when the release layer is not treated with a conditioning fluid before the jetting of the ink. FIG. 4 shows a typical print out on coated paper of a different test file, the printed pattern including a scale of different ink coverages ranging from 2% to 100% and the profile of a human face as complex image. As can be seen in the Figs. and in the table below, the print quality obtained on Condat 135 gsm coated paper using SOL5 was at least equivalent if not better than that obtained using PEI. The average dot size for at least 6 dots taken from two print-outs as represented in FIG. 4 was 41 micrometers for ink printed from the PEI-treated release layer and 42.2 μm for the amine functionalized silicone treated release layer. A larger diameter suggests retention of the spreading of the ink droplet on the release layer and good transfer therefrom.

Similar results were obtained when replacing SOL5 comprising GP-4 by SOL6 comprising GP-316, to be further detailed in Example 7. Interestingly, the so-treated release layer (i.e. GP-316 on CCRL PDMS) was able to satisfactorily transfer the ink image to paper up to about a hundred prints without having to reapply conditioning liquid in between the prints. The results are summarized in the following table:

| Degree of coverage | OD - PEI | OD - GP-4 (SOL5) |
|---|---|---|
| 100%, uncoated paper* | 1.40 | 1.49 |
| 100%, coated paper** | 2.25 | 2.26 |
| 80%, coated paper | 1.26 | 1.36 |
| 30%, coated paper | 0.46 | 0.47 |

*Xerox Business ECF/003R91820 Photocopier Paper DIN A4 80 gsm **Condat 135 gsm

Example 5

The size of the droplets, and the zeta potentials, of the SOL2 and SOL5 emulsions were determined using a Zeta sizer. For SOL2, which had a white, milky appearance, D50 was 3.2 micrometers, and the zeta potential was 30 mV. For SOL5, the corresponding values were 1.1 micrometers and 22 mV, respectively. It will be appreciated that the zeta potentials were positive, indicating the presence of positive charges.

Example 6

The experiment of Example 1 was repeated, but this time the release layer was prepared by addition curing the following components, the part per weight of every ingredient indicated in parentheses for each of the five ACRL compositions:

| Description | ACRL-1 Component (Parts) | ACRL-2 Component (Parts) |
|---|---|---|
| Vinyl polymer | Gelest DMS-V35 (100) | Gelest DMS-V35 (70) Hanse XP RV-5000 (30) |
| Vinyl Resin | Gelest VQM 146 (40) | Gelest VQM 146 (40) |
| Inhibitor | Evonik Inhibitor 600 (3) | Evonik Inhibitor 600 (3) |
| Platinum Catalyst | Gelest SIP6831.2 (0.1) | Gelest SIP6831.2 (0.1) |
| Hydride crosslinker | Gelest HMS-301 (5) | Gelest HMS-301 (12) |

| Description | ACRL-3 Component (Parts) | ACRL-4 Component (Parts) | ACRL-5 Component (Parts) |
|---|---|---|---|
| Vinyl polymer | Gelest DMS-V46 (100) | Gelest DMS-V35 (100) | Gelest DMS-V35 (100) |
| Vinyl Resin | Gelest VQM 146 (40) | Gelest VQM 146 (40) | Gelest VQM 146 (40) |
| Inhibitor | Evonik Inhibitor 600 (5) | Evonik Inhibitor 600 (3) | |
| Platinum Catalyst | Gelest SIP6831.2 (0.1) | Gelest SIP6831.2 (0.1) | Gelest SIP6831.2 (0.1) |
| Hydride crosslinker | Gelest HMS-301 (16) | Gelest HMS-301 (5) | Gelest HMS-301 (5) |
| Functional Additive | Momentive SR-545 (8) | Momentive SR-545 (8) | Lubrizol HP-A89-B1 (5) |

All the ingredients were hand mixed, degassed for five minutes under vacuum (25-40 mmHg), then spread on a substrate (e.g., a blanket body) in a dust-free environment under environmentally controlled conditions of temperature (20-25° C.) and of relative humidity (40-70 RH %). Once uniformly applied on the substrate, the specimens were cured. Generally, the thickness of the addition cured release layer of all so prepared ACRL specimen was between about 40 μm and about 80 μm. The first release layer composition described in above table was cured for one hour at 140° C. to yield addition cured release layer ACRL-1. ACRL-2 to ACRL-5 were cured at temperatures of 100-130° C. for about 15 minutes.

The treatment of ACRL-1, ACRL-2, ACRL-4 and ACRL-5 with the amino silicone fluid (SOL1) facilitated good spreading of the ink on the treated release layer and complete transfer to both types of paper. A typical print-out on coated paper, as transferred for instance from the ACRL-1 treated release layer, is shown in FIG. 5. The treatment with PEI resulted in a discontinuous ink film on the uncoated paper, indicating poor transfer.

As mentioned, SOL1 was prepared by diluting 1:100 in distilled water, an amino silicone of formula I, namely GP-4. Similar experiments were performed with solutions comprising a 1:100 water dilution of X-22 3939A; GP-965; GP-316; and Silamine® D2018 EDA; corresponding respectively to amino silicones of formula I partly substituted with polyether groups; formula II; formula III and formula III partly substituted with polyether groups. These 1% diluted amino silicone fluids were tested on blankets comprising ACRL-1, ACRL-2, ACRL-4 and ACRL-5 release layers, except for the diluted solution of Silamine® D2018 EDA, which was tested on an ACRL-3 surface and found likewise appropriate for suitable spreading of the ink on the release layer and complete transfer to the printing substrates. The diluted solution of X-22 3939A was additionally tested on an ACRL-3 surface and found suitable for proper transfer to the printing substrates.

Example 7

An emulsion of GP-316 (an amine silicone polymer of formula III, in which R═$C_3H_6$, R'═$C_2H_4$, x=400 and y=8, amine number 54, MW ~31,000) (SOL-6) was prepared as follows: 100 parts distilled water, 4 parts GP-316, 0.02 parts Triton X-100 (a surfactant) were mixed by ultrasonic mixing (Vibra mixer from Sonics, 20 kHz, 750 W). The Fujifilm Dimatix printer was used to print 9 pL drops of the afore-described black ink on an addition-cured release layer coated blanket prepared as described in example 6. Print quality was compared by optical density and dot size measurements following transfer to the above-identified coated and uncoated papers. The print quality obtained using SOL6 (comprising about 4 wt. % of GP-316) on the ACRL-1 release layer was compared to print quality obtained using PEI on the condensation cured release layer (CCRL). The average dot size for at least 6 dots taken from two print-outs was 41 micrometers for ink printed from the PEI-treated condensation-cured release layer and 43 μm for the amine functionalized silicone-treated addition-cured release layer. The print-outs obtained from blankets treated with GP-316 were highly similar to the ones obtained from blankets treated with GP-4, see FIG. 5, but for conciseness are not shown. As can be seen in the table below, the print quality obtained using SOL6 for the treatment of a printing blanket having an ACRL-1 outer surface was at least equivalent if not better than that obtained using a printing blanket having a CCRL outer surface conditioned with PEI. SOL6 was not compared to PEI on ACRL-1 blanket, as the reference failed to provide a satisfactory printing baseline. The amino silicones conditioning agents may therefore advantageously be compatible with a broad range of printing blankets.

| Degree of coverage | OD - PEI on CCRL | OD - GP-316 (SOL6) on ACRL-1 |
|---|---|---|
| 100%, uncoated paper | 1.40 | 1.45 |
| 100%, coated paper | 2.25 | 2.20 |
| 80%, coated paper | 1.26 | 1.34 |
| 30%, coated paper | 0.46 | 0.54 |

* Xerox Business ECF/003R91820 Photocopier Paper DIN A4 80 gsm
** Condat 135 gsm When the print-outs of the complex profile pattern were compared, the images obtained from SOL6 treated ACRL-1 blanket were qualitatively better than the images obtained from the PEI CCRL blanket (data not shown). Interestingly, the so treated release layer was able to satisfactorily transfer the ink image to paper up to about a hundred prints without having to reapply conditioning liquid in between the prints. Without wishing to be bound by theory, it is surmised that this may be due to partial penetration of the chemical agent into the release layer.

Example 8

The surface energy of the cured and optionally treated release layers described above was measured using Surface Energy Test Liquids (Dyne level testing following ISO 8296) from Dyne TECHNOLOGY. This form of measurement is based on the ISO method for measuring the surface energy of a polyethylene film. When the Dyne level test liquid is applied to the surface, the liquid will either form a continuous film on the surface or bead into small droplets. If the Dyne test fluid remains as a film for 3 seconds, the substrate will have a minimum surface energy of that fluid value, expressed in milliNewtons/meter (mN/m). Should the Dyne test fluid reticulate or bead into droplets in less than 1 second then the surface energy of the substrate is lower than that of the fluid itself. The exact surface energy (Dyne level) can be determined by applying a range of increasing or decreasing values of Dyne test fluids. The range of test liquids available starts from 23 dyn/cm until 70 dyn/cm (i.e. 23-70 mN/m). The tests were performed at room temperature; the results are shown in the table below:

| Surface | Surface Energy (dyn/cm) ISO8296 |
|---|---|
| Condensation Cured Release Layer (CCRL; Ex. 1) | <23 |
| CCRL + SOL1 | <23 |
| CCRL + SOL2 | <23 |
| CCRL + SOL3 | <23 |
| CCRL + SOL4 | <23 |
| CCRL + SOL5 | <23 |
| CCRL + SOL6 | <23 |
| Addition Cured Release Layer (ACRL; Ex. 6) | <23 |
| ACRL-1 + SOL6 | <23 |

These results confirm that the amino functional silicone treatment fluids do not measurably increase the surface energy of the release layer.

Example 9

The advancing contact angles of a rolling drop (2 μl) of distilled water on the cured and optionally treated release layers above-described, was measured using a Kruss apparatus (camera measurement). For each tested surface, three repeat measurements were performed at room temperature (~23° C.) and the average is presented in the following Table:

| Surface | Advancing Angle (°) |
|---|---|
| Condensation Cured Release Layer (CCRL; Ex. 1) | 105 |
| CCRL + SOL5 | 107 |
| CCRL + SOL6 | 103 |
| Addition Cured Release Layer (ACRL-1; Ex. 6) | 106 |
| ACRL-1 + SOL5 | 105 |
| ACRL-1 + SOL6 | 108 |

This test confirms that the amino functional treatment fluid does not affect the contact angle of a water drop on the release layer in a significant manner.

Example 10

Formulations of different amino silicone materials were made in order to study the relationships between the structure, the amine number, the conditioning effect and the print quality obtained on Coated paper (Condat Gloss 135 gsm). 2 parts of respectively GP-4, GP-6, GP-316, GP-345, GP-965 (all of Genesee Polymer Corporation), and KF864 (Shin Etsu) were emulsified in 100 parts of distilled water using an ultrasonic mixer (Vibra mixer from Sonics, 20 kHz, 750 W). These amino silicone conditioning fluids were compared to a PEI water solution as reference. Each tested conditioning agent was applied to a blanket having a condensation cured PDMS release layer as described in Example 1.

An inkjet ink formulation was prepared containing:

| Ingredient | Function | wt. % |
|---|---|---|
| Heliogen Cyan S 7320 (BASF) | Pigment | 1.5 |
| Joncryl ® 2038 (43.5% emulsion in water) (BASF) | Resin | 13.8 (6% solids) |
| Joncryl ® HPD 296 (35.5% water solution) (BASF) | Dispersant | 4.2 (solid resin) |
| Tween ® 40 | Softening agent | 3.0 |
| BYK 349 | Non-ionic silicone surfactant | 1.0 |
| Ethylene glycol (Aldrich) | Water-miscible co-solvent | 15.0 |
| Water | Carrier | Balance to 100% |

Preparation procedure: A pigment concentrate, containing pigment (14%), water (79%) and Joncryl® HPD 296 (7%) were mixed and milled using a homemade milling machine. The progress of milling was controlled by particle size measurement (Malvern, Nanosizer). The milling stopped when the particle size ($D_{50}$) reached 70 nm. Then the rest of the materials were added to the pigment concentrate. After mixing the ink was filtered through 0.5 micrometer filter to yield the jettable blue ink used thereafter.

The Fujifilm Dimatix printer was used to jet 9 pL drops of this blue ink upon the treated release layer of the printing blanket. Following the drying of the ink for 30 seconds, a piece of coated paper (Condat Gloss 135 gsm) was pressed against the dried inked image and peeled away from the blanket. The print outs so prepared, at least ten per each conditioning fluid, were analyzed as previously described for size of isolated dots and optical density at various ink coverages (100%, 80% and 30%). An untreated blanket was used as control and the dots obtained therefrom were too far from circular shapes to be measured, the entry being therefore marked as Not Relevant (NR). The results presented in the below table are averages of at least 10 dots diameters (in micrometers) and of at least 3 measurements of optical density. The amino silicone materials are listed by increasing amine number from left to right.

| | Untreated Control | PEI | GP 345 | KF 864 |
|---|---|---|---|---|
| Chemical Formula | NR | NR | III | I |
| Amine Number | NR | 1800-2000 | 7 | 27 |
| Dot size | NR | 28.5 | 19.9 | 17.9 |
| OD 100% | 0.238 | 1.68 | 1.42 | 1.34 |
| OD 80% | 0.248 | 1.15 | 0.437 | 0.321 |
| OD 30% | 0.271 | 0.491 | 0.389 | 0.239 |

| | Untreated Control | GP 6 | GP 316 | GP 4 | GP 965 |
|---|---|---|---|---|---|
| Chemical Formula | NR | I | III | I | II |
| Amine Number | NR | 50 | 54 | 90 | 200 |
| Dot size | NR | 28.1 | 28.9 | 28.7 | 26.6 |
| OD 100% | 0.238 | 1.77 | 1.72 | 1.75 | 1.76 |
| OD 80% | 0.248 | 0.958 | 1.17 | 1.07 | 0.801 |
| OD 30% | 0.271 | 0.414 | 0.457 | 0.436 | 0.321 |

From the above table, it is clear that the treatment of the release layer with any of the amino silicones being tested, as well as with the reference PEI solution, significantly improves the quality of the print outs yielding measurable round dots and optical densities up to above six-fold higher than untreated control. Moreover, it seems that for the release layer being used and for the ink being jetted in the present example, the print quality as indicated by dot size measurements improves with increasing amine number till a plateau of dot diameter is reached. This observation is further supported by the optical density read on the print outs at the different ink coverages. Amine silicones of all chemical formulae gave satisfactory results, primary amines, pendant on chain, of formula I, primary and secondary amine, pendant on chain, of formula III and terminated primary amines of formula II.

FIG. 6 shows scans of representative print-outs obtained using the afore-mentioned conditioning fluids and reference agent. It should be noted that as the experiments were performed under the same conditions (e.g., same batch of ink) and preferably on the same day, certain experimental defects (e.g., strike out line resulting from defective print head nozzle) can be ignored for the sake of comparison. Though the OD values retrieved from the ink coverage scale can provide a preliminary indication of the suitability of a candidate agent to serve for treatment of the printing blanket, the print-out of a more complex image, in the present case the profile picture displayed at the bottom of the printed sample, can further help distinguish between the tested materials. For instance, though the OD values measured for the printouts obtained from blankets treated with PEI reference or GP-4, GP-6 and GP-316 look highly similar, the profile image obtained with the amino silicones conditioning agents seems better than the PEI baseline. Understandingly this method herein described to compare different materials can similarly be used to compare different concentrations of a same material, or any other desired parameter. It will be appreciated that such method allows optimizing the formulation of a conditioning fluid suitable for any type of release layer or ink, as exemplified with the blankets having the disclosed CCRL and ACRL release layer being used to transfer aqueous inkjet inks.

The contents of all of the above mentioned applications of the Applicant, as well as other publications mentioned herein, are incorporated by reference as if fully set forth herein.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise" "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" or "at least one impression station" may include a plurality of impression stations.

As used herein, when a numerical value is preceded by the term "about", the term "about" is intended to indicate +/−10%.

Citation or identification of any reference in this application shall not be construed as an admission that such reference is available as prior art to the invention.

Section headings are used herein to ease understanding of the specification and should not be construed as necessarily limiting.

Certain marks referenced herein may be common law or registered trademarks of third parties. Use of these marks is by way of example and shall not be construed as descriptive or limit the scope of this invention to material associated only with such marks.

What is claimed is:

1. A method for treating a hydrophobic release layer of an intermediate transfer member for use in a printing process in which a negatively charged aqueous inkjet ink including an organic polymeric resin and a colorant is jetted onto said layer, the method comprising contacting the release layer with a chemical agent which is an amine functionalized silicone, the amine functionalized silicone having at least 0.3 wt. % nitrogen per weight of the chemical agent, and an amine number of at least 7 and not more than 300, a molecular weight of at least 500 and not more than 50,000.

2. The method of claim 1, the chemical agent having no more than one hydroxyl or alkoxy group per molecule of the amine functionalized silicone.

3. The method of claim 1, wherein silicon atoms constitute at least 33% by weight of the chemical agent.

4. The method of claim 1, the chemical agent having at least one of (a) at most 1.0 Si—H groups, per molecule of the amine functionalized silicone; and (b) at most 1.0 C=C groups, per molecule of the amine functionalized silicone.

5. The method of any claim 1, the chemical agent having a kinematic viscosity of at least 10 square millimeters per second ($mm^2/s$), and of not more than 1,000,000 $mm^2/s$.

6. The method of claim 1, wherein the positive charge density of the chemical agent is at least 0.1 milliequivalent per gram (meq/g) of the chemical agent.

7. The method of claim 1, wherein the chemical agent is a polymer which comprises one or more positively chargeable nitrogen atoms, each chargeable nitrogen atom being selected from the group of primary, secondary and tertiary amines and quaternary ammonium groups.

8. The method of claim 1, wherein the chemical agent is a liquid at about 23° C.

9. The method of claim 1, wherein the amine functionalized silicone is a compound of formula I:

Formula (I)

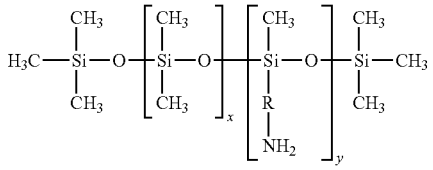

wherein R is $C_{1-6}$ alkyl, the blocks bearing the subscripts x and y may be randomly mixed, the total value of x is from 10 to 5,000, and the total value of y is from 2 to 20.

10. The method of claim 9, wherein one methyl group of at least one dimethyl siloxane repeat subscripted by x is further substituted by a polyether groups comprising $—(OC_2H_4)_a(OC_3H_6)_b—$ optionally terminated by a short alkoxyl of 4 carbon atoms or less or an hydroxyl group; a and b being integers.

11. The method of claim 10, wherein the chemical agent is selected from the group consisting of GP-4 (a compound of formula I wherein $R=(CH_2)_3$, x=58 and y=4), GP-6 (a compound of formula I wherein $R=(CH_2)_3$, x=100 and y=4), GP-581 (a compound of formula I wherein $R=(CH_2)_3$, x=118 and y=11), KF-864 (a compound of formula I having an amine number of about 27-30), X-22 3939A (a compound of formula I wherein part of the dimethyl siloxane repeats are further substituted by polyether groups), and mixtures thereof.

12. The method of claim 1, wherein the chemical agent is applied to the release layer as a conditioning liquid, and a surplus of said conditioning liquid is evened on or removed from the surface of the transfer member.

13. The method of claim 1, the method further comprising removing a vehicle or carrier in which the chemical agent is carried, wherein said removing is optionally achieved by evaporation, and wherein the average thickness of the chemical agent on the release layer after evaporation of the vehicle or carrier is not more than 100 nanometers (nm).

14. The method of claim 1, wherein the hydrophobic outer release layer comprises a silane, silyl or silanol-modified or -terminated polydialkylsiloxane silicone polymer, or hybrids of such polymers.

15. The method of claim 1, wherein the amine functionalized silicone is a compound of formula II:

Formula (II)

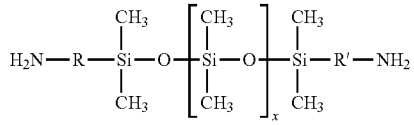

wherein x is from 5 to 5,000, and R and R', which may be the same or different, are each saturated, linear or branched alkyl groups of 1 to 6 carbon atoms.

16. The method of claim 1, wherein the amine functionalized silicone is a compound of formula III:

Formula (III)

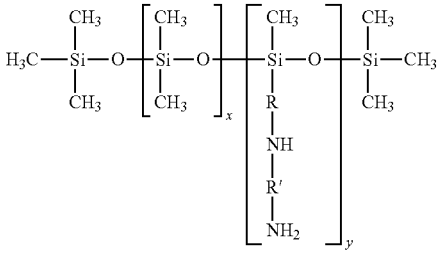

wherein the blocks bearing the subscripts x and y may be randomly mixed, the total value of x is from 5 to 5,000, the total value of y is from 1 to 20, and R and R', which may be the same or different, are each saturated, linear or branched alkyl groups of 1 to 6 carbon atoms.

17. The method of claim 12, wherein the chemical agent is applied to the release layer so that a thickness of the conditioning liquid on the release layer prior to removal of the bulk of the carrier is less than 100 micrometers (μm).

18. The method of claim 1, wherein a temperature of the release layer, when contacted with the chemical agent, is at least 40° C. and not more than 150° C.

19. The method of claim 1, wherein the method further comprises jetting an ink drop to form an ink film on the chemical agent on the release layer, wherein a ratio of charges in the ink film to charges in the chemical agent in a region covered by said ink film is at least at least 10:1.

20. The method of claim 1, wherein the method further comprises jetting an aqueous inkjet ink image on the release layer having the chemical agent thereupon; the aqueous inkjet ink comprising an aqueous solvent, a colorant which is preferably a pigment, and a negatively chargeable polymeric resin; removing the solvent from the jetted aqueous inkjet ink; and transferring the image to a substrate.

* * * * *